US007245195B2

(12) United States Patent
Satoh et al.

(10) Patent No.: US 7,245,195 B2
(45) Date of Patent: Jul. 17, 2007

(54) COPLANAR WAVEGUIDE FILTER AND METHOD OF FORMING SAME

(75) Inventors: Kei Satoh, Yokosuka (JP); Shoichi Narahashi, Yokohama (JP); Tetsuo Hirota, Kanazawa (JP); Yasushi Yamao, Yokosuka (JP)

(73) Assignee: NTT DoCoMo, Inc., Tokyo (JP)

( * ) Notice: Subject to any disclaimer, the term of this patent is extended or adjusted under 35 U.S.C. 154(b) by 164 days.

(21) Appl. No.: 11/046,923

(22) Filed: Feb. 1, 2005

(65) Prior Publication Data

US 2005/0206480 A1 Sep. 22, 2005

(30) Foreign Application Priority Data

Feb. 3, 2004 (JP) ..... 2004-027187
Feb. 3, 2004 (JP) ..... 2004-027219
Sep. 7, 2004 (JP) ..... 2004-259685

(51) Int. Cl.
*H01P 1/20* (2006.01)
*H01P 3/08* (2006.01)

(52) U.S. Cl. ..... 333/204; 333/219; 333/99 S

(58) Field of Classification Search ..... 333/204, 333/219, 246, 99 S

See application file for complete search history.

(56) References Cited

U.S. PATENT DOCUMENTS 5,750,473 A 5/1998 Shen
6,262,640 B1 * 7/2001 Tsujiguchi ..... 333/204

FOREIGN PATENT DOCUMENTS

EP 0 933 831 A1 8/1999

OTHER PUBLICATIONS

Guru Subramanyam, et al., "Ferroelectric Thin-film Based Electrically Tunable Ku-band Coplanar Waveguide Components", IEEE MTT-S International Microwave Symposium Digest, vol. 1 of 3, XP-001067319, May 20, 2001, pp. 471-474.
Hideyuki Suzuki, et al., "A Low-Loss 5 GHz Bandpass Filter Using HTS Quarter-Wavelength Coplanar Waveguide Resonators", IEICE Trans. Electron., vol. E-85-C, No. 3, Mar. 2002, pp. 714-719.

* cited by examiner

*Primary Examiner*—Benny Lee
*Assistant Examiner*—Kimberly E Glenn
(74) *Attorney, Agent, or Firm*—Oblon, Spivak, McClelland, Maier & Neustadt, P.C.

(57) ABSTRACT

A plurality of one-quarter wavelength coplanar resonators 5*a* to 5*d* are formed in series on a dielectric substrate 1, and coplanar input/output terminal sections 4*a* and 4*b* are formed on the dielectric substrate at opposite ends of the series connection for coupling with resonators 5*a* and 5*d*, respectively. A center conductor line width $w_1$ of each of the resonators 5*a* to 5*d* is equal to a center conductor line width $w_{io}$ of each of the input/output terminal section 4*a* and 4*b*, but a ground conductor spacing $d_1$ of each of the resonators 5*a* to 5*d* is greater than a ground conductor spacing $d_{io}$ of each of input/output terminal section 4*a* and 4*b*. Maintaining the accuracy of design is facilitated and a reduction in the maximum current density in the resonator is enabled.

17 Claims, 19 Drawing Sheets

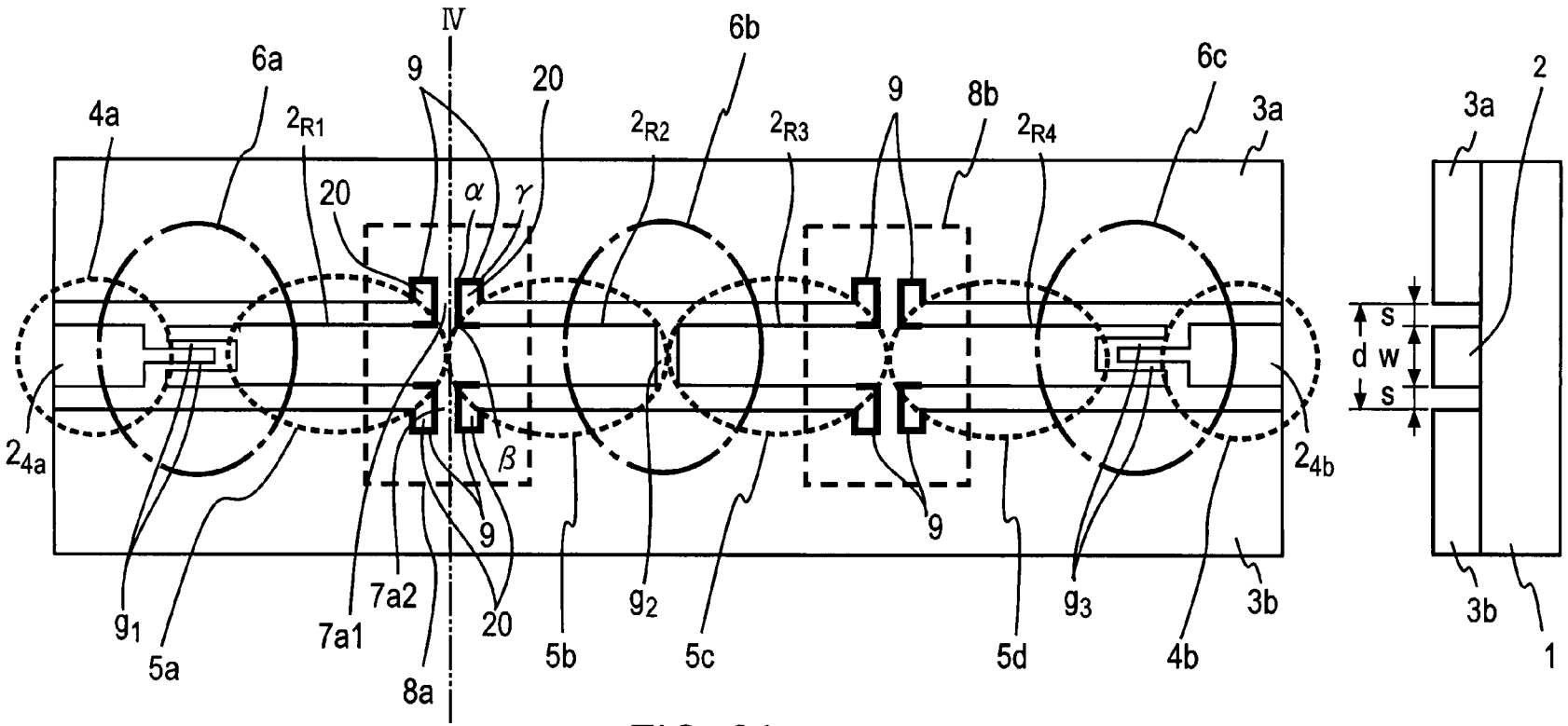
FIG. 2A
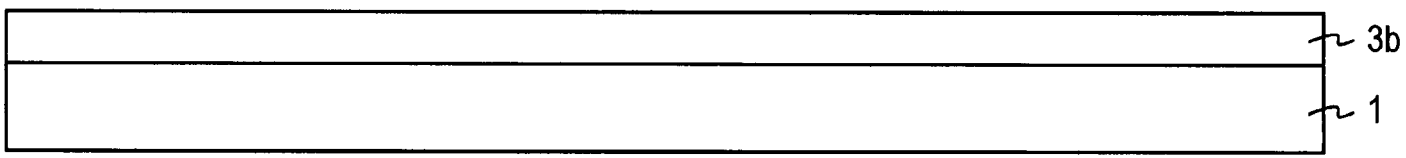
FIG. 2B
FIG. 2C
PRIOR ART

COPLANAR WAVEGUIDE FILTER AND METHOD OF FORMING SAME

BACKGROUND OF THE INVENTION

The present invention relates to a coplanar waveguide filter which is used in a selective separation of signals in a particular frequency band in the field of a mobile communication, satellite communication, fixed microwave communication and other communication technologies, in particular, to such filter constructed with a coplanar line, and a method of forming same.

Recently, a coplanar waveguide filter constructed with coplanar lines is proposed to be used as a filter which is used in the separation of signals in the transmission and reception of a microwave communication. The concept of a coplanar line will be described with reference to FIG. 1.

In FIG. 1, formed on a dielectric substrate 1 are a ribbon-like center conductor 2 and a first and a second ground conductor 3*a* and 3*b* disposed on the opposite sides of the center conductor 2 with an equal spacing therebetween. The three members including the center conductor 2, the first and the second conductor 3*a* and 3*b* are formed parallel to and coplanar with each other on the common surface of the dielectric substrate 1. The coplanar line has features that no via-holes are not required in forming an inductive coupler, a miniaturization is possible without changing a characteristic impedance and that a greater freedom of design is available. Denoting the width of the center conductor 2 by w and the spacing between the center conductor 2 and each of the first and the second ground conductor 3*a* and 3*b* by s, the coplanar line has a characteristic impedance which is determined by the line width w of the center conductor 2 and the spacing d(w+2s) between the first and the second ground conductor 3*a* and 3*b*.

Referring to FIGS. 2A to 2C, a conventional example of the coplanar wave guide filter will now be described where a first to a fourth resonator 5*a* to 5*d* are disposed on a line. Each resonator comprises a center conductor 2 having an electrical length equivalent to one-quarter wavelength and a first and a second ground conductor 3*a* and 3*b* disposed on the opposite sides of and parallel to the center conductor 2 and spaced therefrom by a spacing s, which are formed on the common surface of a dielectric substrate 1.

A first input/output terminal section 4*a* of a coplanar waveguide to which a signal is input is capacitively coupled to the first resonator 5*a*. In the example shown, one end of a center conductor line $\mathbf{2}_{4a}$ of the first input/output terminal section 4*a* and one end of a center conductor line $\mathbf{2}_{R1}$ of the first resonator 5*a* are disposed in mating relationship with each other in the manner of comb teeth and spaced by a gap g1 in order to strengthen the capacitive coupling, thus forming a first capacitive coupler 6*a*. The other end of the center conductor line $\mathbf{2}_{R1}$ and one end of a center conductor line $\mathbf{2}_{R2}$ of a second resonator 5*b* are connected together by shorting line conductors 7*a*1 and 7*a*2 which are connected to the first and the second ground conductor 3*a* and 3*b*, respectively, thus forming a first inductive coupler 8*a* between the first and the second resonator 5*a* and 5*b*.

Cuts 20 are formed into the first and the second ground conductor 3*a* and 3*b* on each side of the shorting line conductors 7*a*1 and 7*a*2, whereby the shorting line conductors 7*a* are apparently extended, increasing the degree of coupling of the first inductive coupler 8*a*. A gap g2 is provided between the other end of the center conductor line $\mathbf{2}_{R2}$ of the second resonator 5*b* and one end of a center conductor line $\mathbf{2}_{R3}$ of a third resonator 5*c*, whereby the second and the third resonator 5*b* and 5*c* are coupled together by a second capacitive coupler 6*b*.

The other end of the center conductor line $\mathbf{2}_{R3}$ and one end of a center conductor line $\mathbf{2}_{R4}$ of a fourth resonator 5*d* are connected together by shorting line conductors 7*b*1 and 7*b*2 and connected to ground connectors 3*a* and 3*b*, whereby the third and the fourth resonator 3*c* and 5*d* are coupled together by a second inductive coupler 8*b*. In the second inductive coupler 8*b*, also cuts 20 are formed into the ground conductors 3*a* and 3*b*.

The fourth resonator 5*d* and a second input/output terminal section 4*b* are capacitively coupled. Specifically, the other end of the center conductor line $\mathbf{2}_{R4}$ and a center conductor line $\mathbf{2}_{4a}$ of the second input/output terminal section 4*b* are formed in the configuration of meshing comb teeth and disposed in opposing relationship and spaced apart by a gap g3, thus forming a third capacitive coupler 6*c* which provides a strong coupling therebetween.

As mentioned above, the characteristic impedance of the coplanar line is determined by the width w of the center conductor line and the ground conductor spacing d(w+2s) between the first and the second ground conductor 3*a* and 3*b*. However, the resonators 5*a*, 5*b*, 5*c* and 5*d* which form together a conventional waveguide filter has a characteristic impedance of 50Ω which is the same as the characteristic impedance of various devices connected to the input/output terminal section 4 for the ease of design. (See, for example, H. Suzuki, Z. Ma, Y. Kobayashi, K. Satoh, S. Narashima and T. Nojima: "A low-loss 5 GHz bandpass filter using HTS quarter-wavelength coplanar waveguide resonators", IEICE Trans. Electron., vol. E-85-C, No. 3, pp 714-719, March 2002.)

Accordingly, in the practice of forming the coplanar waveguide filter, a pattern such as shown in FIG. 1A is formed by an etching of conductor films on a dielectric substrate by designing a filter which satisfies an intended filter response with a characteristic impedance of 50Ω while choosing a ground conductor spacing $d_1$ and a center conductor line width $w_1$ of an input/output terminal section which are equal to a ground conductor spacing $d_2$ and a center conductor line width $w_2$ of a resonator, respectively. Power is fed to the resulting coplanar waveguide filter and a maximum input power is determined so that a power loss which occurs is equal to or less than a given value or if a superconducting material is used to form a conductor film which is etched, a maximum power input is determined so as to avoid a loss of the superconducting state. In other words, a maximum input power level could not have been determined until after a filter has been formed.

FIG. 3 graphically shows a current density distribution of a conventional coplanar waveguide filter. In FIG. 3, the X-axis represents the direction of length of the coplanar line while Y-axis represents a direction which is orthogonal thereto, and a current density at a given coordinate is indicated along the ordinate. It will be seen from FIG. 3 that the current density is at its maximum on the edge line 9 (indicated in thick lines) of the first and the second inductive coupler 8*a* and 8*b*, as will be further described later, and this has been an essential factor which causes an increased power loss.

The current density assumes a maximum value of about 2200 A/m at the first inductive coupler 8*a* which is located at a distance of about 8.5 mm from the input of the coplanar line and also at the second inductive coupler 8*b* which is located at a distance of about 20 mm from the input. FIG. 4 graphically shows a current density distribution of the first inductive coupler 8*a* to an enlarged scale. The position along the X-axis shown in FIG. 4 represents a length as referenced to a signal input end of the first input/output terminal section 4*a* shown in FIG. 2, and a position corresponding to 8.892 mm is indicated in FIG. 2 by a line IV-IV. Specifically, an X-axis position which steps back by 0.014 mm toward the input from the lateral edge of the shorting line conductor 7*a*1 which is located toward the second resonator 5*b* represents 8.892 mm position shown in FIG. 4. FIG. 4 shows a current density distribution in the range of 0.1 mm from this position toward the output. It will be seen that the current density is particularly high at two locations including a corner α where the shorting line conductor 7*a*1 contacts the first ground conductor 3*a* and another corner β where the shorting line conductor 7*a*1 contacts the center conductor line $\mathbf{2}_{R2}$ and that the current is concentrated at a corner γ located on the opposite side from the corner α of the rectangular cut 20 into the first ground conductors 3*a* which is provided for the purpose of increasing the degree of coupling of the inductive coupler 8. Such peaks of the current concentration also occur at respective corners which are located in line symmetry with respect to the centerline which is drawn through the center of the width of the shorting line conductor 7*a*1 from the corners α, β and γ. A particularly high current concentration peak occurs at three corners α, β and γ. It should be understood that the same tendency prevails on the side of the second ground conductor 3*b*, producing a current concentration at each corner between the shorting line conductor 7*a*2 and the center conductor line $\mathbf{2}_{R2}$ and the second ground conductor 3*b*.

In a conventional filter, an approach to increase the degree of coupling of the inductive coupler has been to reduce the width of the shorting line conductors 7*a*1 and 7*a*2 or to increase the substantial length of the shorting line conductors by providing cuts 20 into the ground conductors 3. As a result of such approach, the current concentration occurs at corners of the shorting line conductor which forms the inductive coupler and there arises a problem in a filter in which the conductive films on the dielectric substrate are formed of a superconducting material that the superconducting state is destructed by the occurrence of a current concentration which exceeds a critical current density if the resonator were refrigerated below a critical temperature.

There also arises a problem that the configurational construction of the shorting conductors 7*a*1, 7*a*2, 7*b*1 and 7*b*2 becomes finer or complicated, presenting a difficulty in securing the accuracy of design.

The present invention has been made in consideration of these aspects, and has for its object the provision of a coplanar waveguide filter which reduces a maximum current density in a resonator and avoids an increase in the power loss with a construction which assures that the accuracy of design can be maintained and which prevents a superconducting state from being destructed if component conductor films were formed of a superconducting material.

It is also to be understood that in a conventional method of forming, the power of a filter input signal is determined after a coplanar waveguide filter has been formed, and it has been difficult to manufacture a filter having a desired response with respect to a predetermined power of the input signal.

SUMMARY OF THE INVENTION

The present invention provides a coplanar waveguide filter comprising a dielectric substrate, a coplanar resonator formed by a center conductor line and ground conductors which are formed on the dielectric substrate, and a coplanar input/output terminal section which is coupled with the resonator through a coupler and wherein one of the ground conductor spacing and the center conductor line width of the coplanar resonator is made to be greater than a corresponding one of the ground conductor spacing and the center conductor line width of the input/output terminal section.

According to the present invention, a concentration of the current density in the coplanar resonator is alleviated to reduce a power loss, and when conductor films which defines filter are formed of a superconducting material, a destruction of the superconducting state is prevented.

According to a forming method of the present invention, a ground conductor spacing and a center conductor line width with respect to a given maximum current density (power) is determined on the basis of a relationship between a predetermined maximum current density and a ratio of the center conductor line width with respect to the spacer conductor spacing for a dielectric substrate and a ground conductor material, and a pattern of a center conductor line and ground conductors is formed on the dielectric substrate on the basis of the determined values.

With this forming method, it is possible to form a coplanar waveguide filter for a required input power which is predetermined.

BRIEF DESCRIPTION OF THE DRAWINGS

FIG. 2A is a plan view of a conventional coplanar waveguide filter;

FIG. 2B is a right-hand side elevation of FIG. 2A;

FIG. 2C is a front view of FIG. 2A;

BEST MODES FOR CARRYING OUT THE INVENTION

Modes of carrying out the present invention will now be described below with reference to the drawings.

FIRST MODE OF CARRYING OUT THE INVENTION

EMBODIMENT 1

Figures 5A, 5B, 5C:
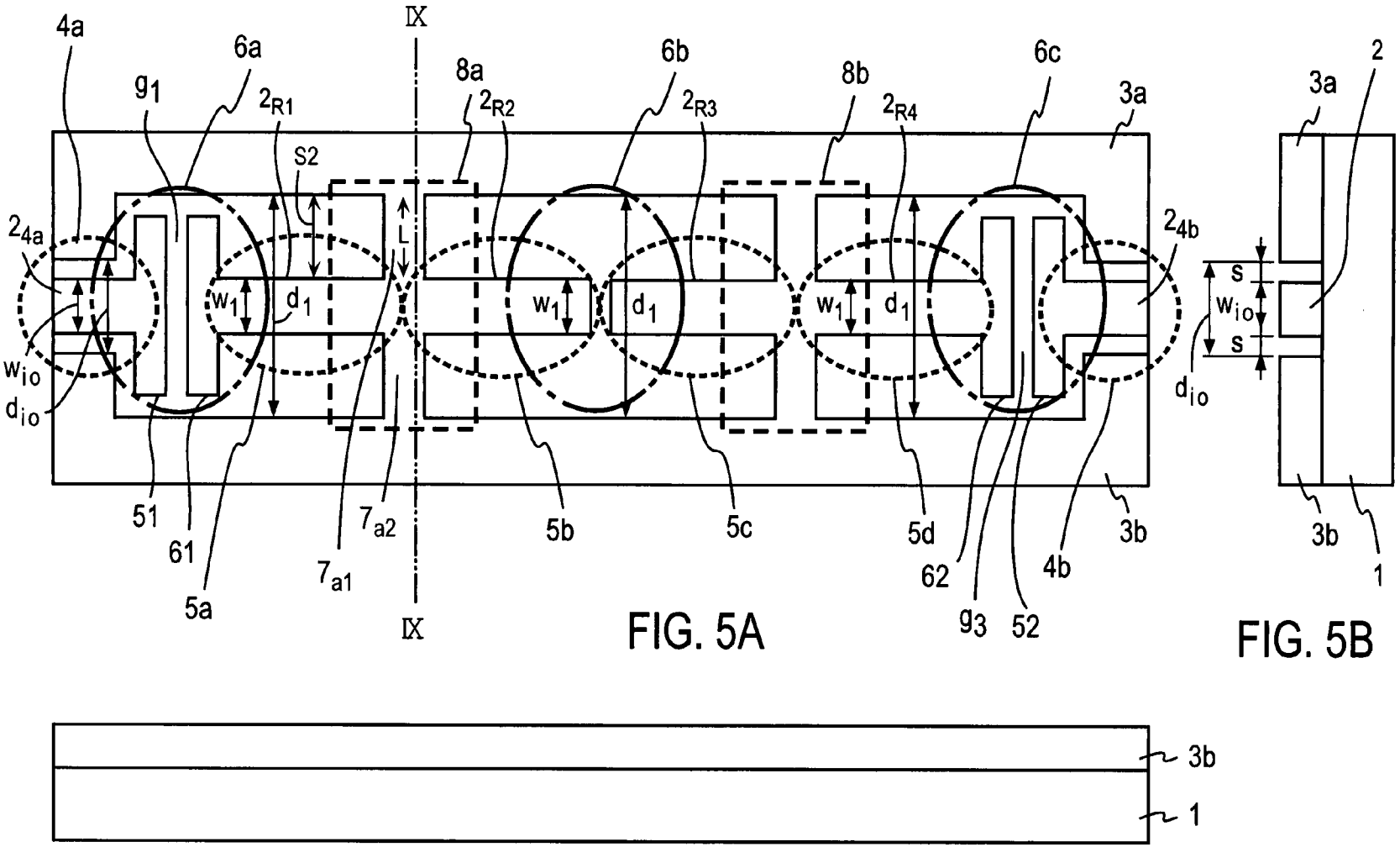
FIG. 5A is a plan view of one-quarter wavelength four stage coplanar waveguide filter according to a first mode of carrying out the present invention.
FIG. 5B is a right-hand side elevation of FIG. 5A.
FIG. 5C is a front view of FIG. 5A.

A first mode of carrying out the present invention will be described with reference to FIGS. 5A to 5C. This mode of carrying out the invention is shown in the form of one-quarter wavelength four stage coplanar waveguide filter in which one-quarter wavelength coplanar resonators 5*a* to 5*d* are arranged on a line in the similar manner as shown in FIG. 2. As a distinction, a ground conductor spacing $d_1$ between the ground conductors 3*a* and 3*b* of each of the resonators forming the coplanar waveguide filter is chosen to be greater than a ground conductor spacing $d_{io}$ of each of input/output terminal sections 4*a* and 4*b*.

A characteristic impedance of a first/output terminal section 4*a* to which a signal is input is chosen to be 50Ω, for example, from the standpoint of matching with the characteristic impedance of a device which is connected thereto.

Accordingly, in the present example, the width $w_{io}$ of each center conductor each line $\mathbf{2}_{4a}$, and $\mathbf{2}_{4b}$ of the first and the second input/output terminal section 4*a* and 4*b* is chosen to be 0.218 mm and the ground conductor spacing $d_{io}$ is chosen to be 0.4 mm. On the other hand, in each of the resonators 5*a* to 5*d* which are arranged between the first and the second input/output terminal section 4*a* and 4*b*, each of center conductor $\mathbf{2}_{R1}$ to $\mathbf{2}_{R4}$ has a width $w_1$ which is equal to 0.218 mm and thus is equal to that of the input/output terminal sections 4*a* and 4*b*, but each ground conductor spacing $d_1$ is chosen to be greater than 0.4 mm and lies in a range equal to or less than a maximum value of 1.78 mm in FIG. 5. Thus, in this example, the ground conductor spacing $d_1$ of each resonator is greater than the ground conductor spacing $d_{io}$ of each of the first and the second input/output terminal section 4*a* and 4*b*. However, as will be evident from FIG. 6, when the ground conductor spacing $d_1$ is increased, the imax, n-k characterisitic curve shifts downward in this Figure, and the curve becomes moderately sloped, and therefore, $d_1$ is not restricted to be equal to or less than 1.78 mm mentioned above.

Capacitive coupling ends 51 and 61 which form a first capacitive coupler 6*a* between the first input/output section 4*a* and the first resonator 5*a* are extended toward the ground conductors 3*a* and 3*b* in a manner corresponding to the increased ground conductor spacing $d_1$, and are disposed in a closely opposing manner and spaced by a gap $g_1$. The length over which the ends 51 and 61 are disposed in opposing relationship is chosen to be equal to the opposing length between the coupling ends in the first capacitive coupler 6*a* shown in FIG. 2, for example. Thus, the first capacitive coupler 6*a* is formed by a simple construction in which the coupling ends are opposing along rectilinear lines rather than using a complicated meshing comb teeth structure.

Shorting line conductors 7*a*1 and 7*a*2 which couple between the first and the second resonator 5*a* and 5*b* have a sufficient length to provide a satisfactory degree of coupling to serve as a first inductive coupler 8*a* without forming cuts 20 as shown in FIG. 2A into the first ground conductor 3*a* and the second ground conductor 3*b* in the region of junction between these shorting line conductors 7*a*1 and 7*a*2 and the first and the second ground conductor 3*a* and 3*b* because the ground conductor spacing $d_1$ is greater than a corresponding value of the prior art. Accordingly, the first inductive coupler 8*a* also has a simpler construction than that shown in FIG. 2.

A second inductive coupler 8*b* is constructed in the same manner as the first inductive coupler 8*a*. Thus, in the first mode of carrying out the invention, cuts 20 into the ground conductors which have been used in the prior art for increasing the degree of coupling of the inductive couplers 8*a* and 8*b* are not formed. In other words, a spacing S2 between the center conductor lines $\mathbf{2}_{R1}$ to $\mathbf{2}_{R4}$ and the ground conductors 3*a* and 3*b* is equal to the length L of each of the shorting line conductors 7*a*1, 7*a*2, 7*b*1 and 7*b*2 which form the inductive couplers 8*a* and 8*b*, and thus, there is no rectangular cuts 20 formed into the ground conductors 3*a* and 3*b*.

Stated differently, the shorting line conductors 7*a*1 and 7*b*1 are connected at right angles with the ground conductor 3*a*, and the edge of the junction disposed toward the ground conductor extends to the position of the first and the second capacitive coupler 6*a* and 6*b* parallel to the center conductor lines $\mathbf{2}_{R1}$ and $\mathbf{2}_{R4}$.

As a consequence, the shorting line conductors 7*a* and 7*b* and their junction with the ground conductors assume a simple configuration which can easily be manufactured, reducing corners on the current carrying lines where the current density is likely to be concentrated. An arrangement which follows the first resonator 5*a* is identical with the arrangement of the one-quarter wavelength four stage coplanar filter described above in connection with FIG. 2 except that the coupling ends of the capacitive coupler are changed in configuration and that no cuts are formed in the region of the junction between the shorting line conductors which form the inductive coupler and the ground conductors. Accordingly, only a connection thereof will be described briefly.

Because the shorting line conductors 7*a* and 7*b* are constructed in the manner mentioned above, a spacing between each center conductor line $\mathbf{2}_{R2}$, $\mathbf{2}_{R3}$ and $\mathbf{2}_{R4}$ and the ground conductors 3*a* and 3*b* of the resonators 5*b*, 5*c* and 5*d* is equal to S2. A second capacitive coupler 6*a* disposed between the second resonator 5*b* and the third resonator 5*c* is constructed in the same manner as the second capacitive coupler 6*a* shown in FIG. 2. A third capacitive coupler 6*c* disposed between the fourth resonator 5*d* and the second input/output terminal section 4*b* is constructed in the similar manner as the first capacitive coupler 6*a* shown in FIG. 5. Specifically, a capacitive coupling end 62 at one end of the center conductor line $\mathbf{2}_{R4}$ and a capacitive coupling end 52 at one end of the center conductor $\mathbf{2}_{4b}$ are simply wider linear members which are crosswise extended on the both sidse with respect to each side of the center conductor line, and are closely spaced apart and opposing each other to increase the degree of coupling. The second input/output terminal section 4*b* has a center conductor line width $w_{io}$ equal to 0.218 mm, a ground conductor spacing $d_{io}$ equal to 0.4 mm and a characteristic impedance of 50Ω in order to match the characteristic impedance of an external device which is connected thereto.

Figure 6:
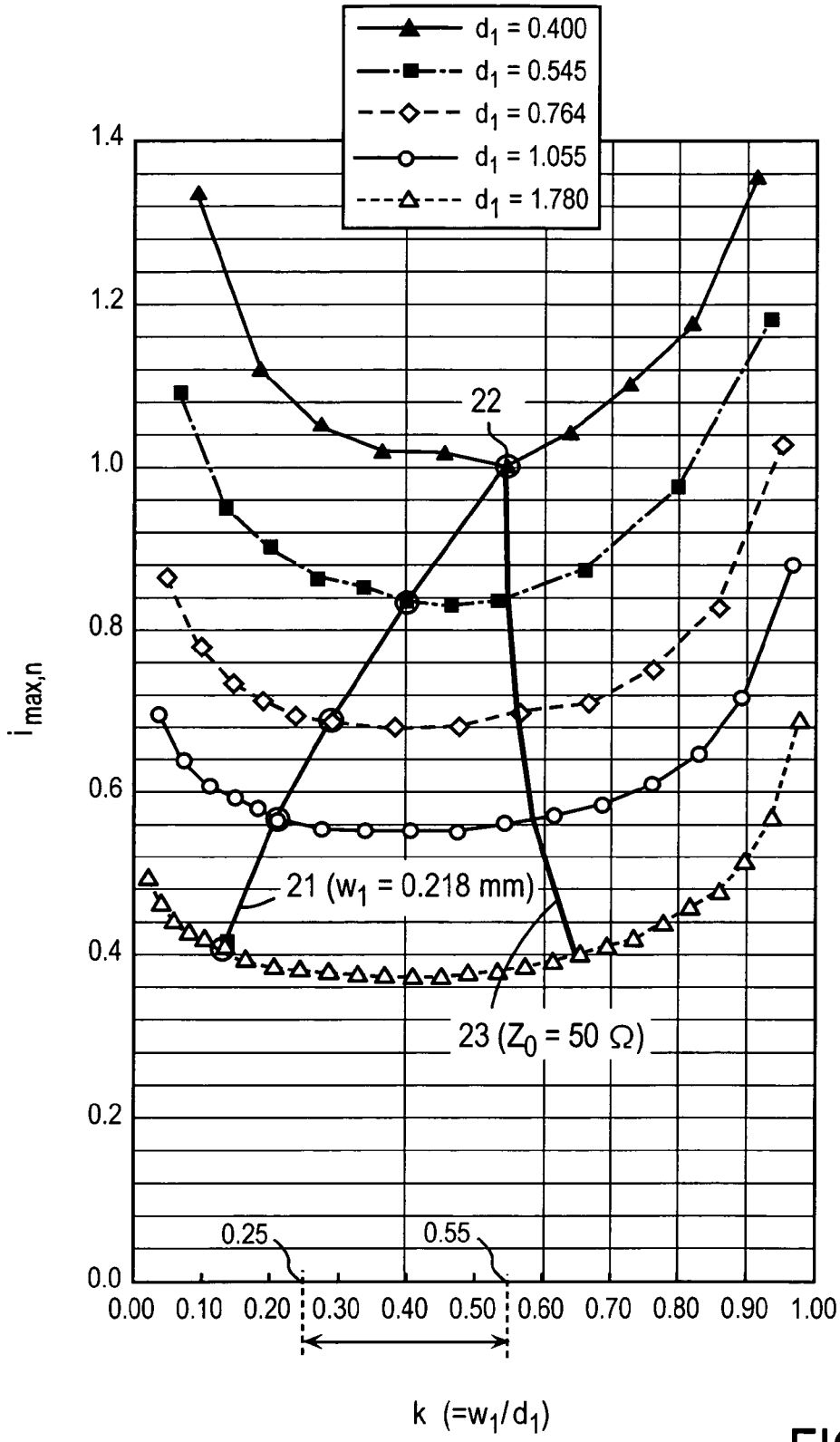
FIG. 6 graphically shows a relationship between the maximum current density and a ratio k of a center conductor line width $w_1$ with respect to a ground conductor spacing $d_1$ of a resonator according to the first mode.

A result of simulation for a relationship between a maximum current density of a current flow through the filter and the ratio k between a center conductor line width $w_1$ and a ground conductor spacing $d_1$ of a resonator for a single resonator in the one-quarter wavelength four stage coplanar waveguide filter constructed in the manner shown in FIG. 5 is graphically shown in FIG. 6, using the ground conductor spacing $d_1$ as a parameter. Thus, this result is obtained by performing the simulation under the condition that no rectangular cuts 20 are formed into the ground conductors in the region of the inductive coupler. The simulation took place with an input of a sinusoidal wave of a voltage 1 Vpp and of a frequency 5 GHz. In FIG. 6, the abscissa represents the ratio k of the center conductor line width $w_1$ with respect to the ground conductor spacing $d_1$ or $w_1/d_1$ while the ordinate represents a maximum current density $i_{max,n}$ which is normalized by the maximum current density which occurs in a resonator utilizing a ground conductor spacing $d_1$=0.4 mm and an impedance of 50Ω. The ground conductor spacing $d_1$ which is used as the parameter is chosen to be 0.4 mm, 0.545 mm, 0.764 mm, 1.055 mm and 1.780 mm. Accordingly, the center conductor line width will be at its maximum when the ground conductor spacing $d_1$ is equal to 1.780 mm, allowing the center conductor line width $w_1$ to be variable in a range from 0.035 mm to 1.744 mm (which is assumed when the ground conductor spacing $d_1$ is equal to 1.780 mm). When the center conductor line width $w_1$ is increased while maintaining the ground conductor spacing $d_1$ constant, the maximum current density exhibits a response having a concave configuration such as a quadratic curve.

Data plotted by a thin line 21 in FIG. 6 represents data obtained when the center conductor width $w_1$ is kept constant at 0.218 mm. When the ground conductor spacing $d_1$ is equal to 0.4 mm, it follows that k=0.54, and this point 22 is chosen to be as representing 1.0 for normalization of the maximum current density. When the ground conductor spacing d1 is increased to 0.545 mm, it follows that k=0.4, whereby the normalized maximum current density (hereafter simply referred to as "current density") is reduced to about 0.83. When the ground conductor spacing $d_1$ is further increased to 0.764 mm, it follows that k=0.29, whereby the current density is reduced to about 0.69. When the ground conductor spacing $d_1$ is increased to 1.055 mm, it follows that k=0.2, whereby the current density is reduced to about 0.56. When the ground conductor spacing $d_1$ is increased to 1.78 mm, it follows that k=0.12, whereby the current density is reduced to about 0.4.

In this manner, when the center conductor line width $w_1$ is kept constant, the maximum current density of the resonator is reduced as the ground conductor spacing $d_1$ is increased.

FIG. 6 will be more closely considered. As mentioned previously, when the ground conductor spacing $d_1$ is equal to 0.4 mm, k=0.54 and the characteristic impedance is equal to 50Ω. At this point 22, the maximum current density is normalized to 1.0. Assuming that a usuable range is within +10% from the smallest value of the current density, when the ground conductor spacing $d_1$ is equal to 0.4 mm, the range of k in which the maximum current density is equal to or less than 1.1 will be located in a range from 0.20 to 0.73.

When the ground conductor spacing $d_1$ is equal to 0.545 mm, the maximum current density will be 0.83 and assumes a smallest value for k=0.47. Accordingly, the useable range in which the maximum current density remains within +10% from the smallest value will be from k=0.19 where the maximum current density is 0.91 to k=0.71. When the ground conductor spacing $d_1$ is equal to 0.764 mm, the maximum current density assumes a smallest value of 0.68 at k=0.4. Accordingly, the useable range within which the maximum current density remains within +10% will be from k=0.13 where the maximum current density is 0.75 to k=0.76. When the ground conductor spacing $d_1$ is equal to 1.055 mm, the maximum current density assumes a smallest value of 0.55 at k=0.4. Accordingly, the useable range within which the maximum current density remains within +10% is from k=0.11 where the maximum current density is 0.61 to k=0.75. Considering the ground conductor spacing $d_1$ equal to 1.780 mm, the maximum current density assumes a minimum value of 0.37 at k=0.41, and a useable range within which the maximum current density remains within +10% is from k=0.12 where the maximum current density is 0.41 to k=0.70.

From the results mentioned above, it will be seen that for a value of the ground conductor spacing $d_1$ in a range from 0.4 to 1.78 mm as considered above, the maximum current density can be maintained within +10% from the smallest value for a range from k=0.20 to k=0.70.

In this manner, the ground conductor spacing $d_1$ and the center conductor line width $w_1$ are set up in the manner corresponding to a center portion of a range in which there is no substantial change in the maximum current density with respect to a change in k. A coplanar waveguide filter is then formed by etching conductor films on the dielectric substrate in conformity to the ground conductor spacing $d_1$ and the center conductor line width $w_1$ which are set up and so that an intended filter response can be satisfied. It is then possible to form a coplanar waveguide filter in a simple manner in conformity to a demanded specification by previously determining a range in which there is no substantial change in the maximum current density with respect to k.

A thick line 23 in FIG. 6 represents a curve joining points where the characteristic impedance $Z_0$ of the resonator is constant at $Z_0$=50Ω. A center conductor line width $w_1$ which provides a characteristic impedance $Z_0$ of 50Ω when the ground conductor spacing $d_1$ is equal to 0.4 mm is given by $w_1$=0.218 mm, and this point is where the maximum current density is normalized to 1.0. A center conductor line width $w_1$ which provides a characteristic impedance $Z_0$ of 50Ω when the ground conductor spacing $d_1$ is equal to 0.545 mm is given by $w_1$=0.325 mm, and the current density is about 0.84. A center conductor line width $w_1$ which provides a characteristic impedance $Z_0$ of 50Ω when the ground conductor spacing $d_1$ is equal to 0.764 mm is given by $w_1$=0.482 mm, and the current density is about 0.70.

A center conductor line width w, which provides a characteristic impedance $Z_0$ of 50Ω when the ground conductor spacing $d_1$ is equal to 1.055 mm is given by $w_1$=0.707 mm, and the current density is about 0.56. A center conductor line width $w_1$ which provides a characteristic impedance $Z_0$ of 50Ω when the ground conductor spacing $d_1$ is equal to 1.78 mm is given by $w_1$=1.308 mm, and the current density is about 0.4.

When the characteristic impedance $Z_0$ of the resonator is made constant at 50Ω, for example, the maximum current density of the resonator can be reduced as the center conductor line width $w_1$ is increased. A choice of $d_1$ which is greater than $d_{io}$ leads to a reduction in the maximum current density, and it is preferred to choose $w_1$ which is greater than $w_{io}$ in order to maintain the characteristic impedance constant, and imax,n can be held as small as possible by the adjustment of the both parameters.

Figure 7:
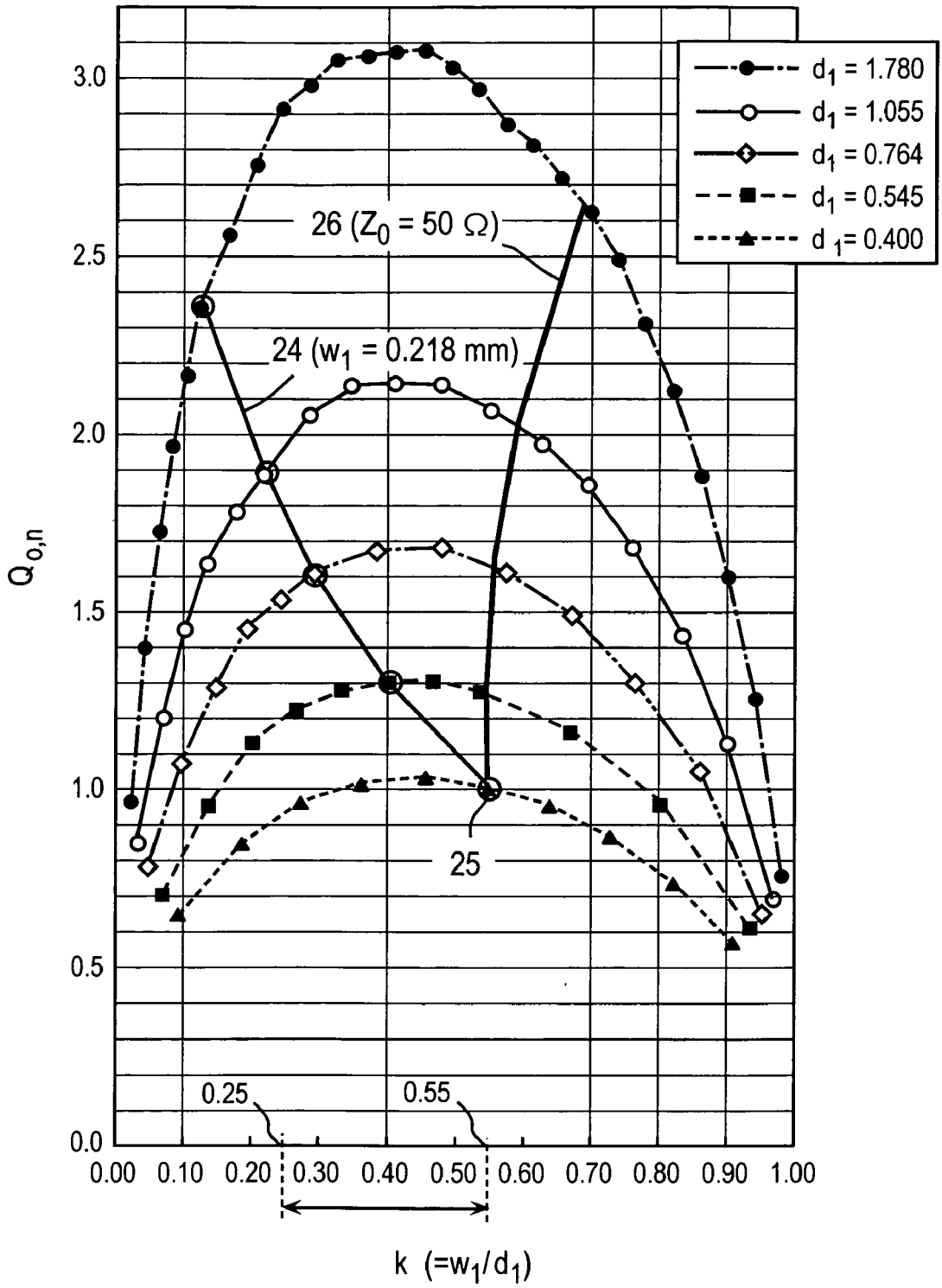
FIG. 7 graphically shows a relationship between no-load Q value of the resonator and the ratio k of the center conductor line width $w_1$ with respect to the ground conductor spacing $d_1$ of the resonator according to the first mode.

A reduction in the maximum current density has an effect of reducing a conductor loss in the resonator. FIG. 7 shows a relationship between a no-load Q value of the resonator and k. In FIG. 7, the abscissa represents the ratio of the center conductor line width $w_1$ with respect to the ground conductor spacing $d_1$ or $k=w_1/d_1$ while the ordinate represents a no-load Q value $Q_{0,n}$ when the no-load Q value at the characteristic impedance 50Ω for the ground conductor spacing $d_1$=0.4 mm is normalized to a reference 1.0. Generally in a range of k from 0.25 to 0.55, the no-load Q value of the resonator assumes its maximum. A thin solid line 24 represents a curve joining points where the center conductor line width $w_1$ is constant at 0.218 mm. A thick solid line 26 represents a curve which joins points where the characteristic impedance $Z_0$=50Ω prevails starting from a point 25 where the characteristic impedance $Z_0$=50Ω for the center conductor line width $w_1$=0.218 and the ground conductor spacing $d_1$=0.4 mm.

Where a low insertion loss response is required of a coplanar filter, an arrangement may be made to set up a ratio k of the center conductor line width with respect to the ground conductor spacing which provides a maximum no-load Q value of the resonator.

A relationship between the characteristic impedance and the ratio of the center conductor line width $w_1$ with respect to the ground conductor spacing $d_1$ will now be described. A relationship between a current and a voltage on a distributed constant line is generally given by following equations:

$$\dot{I} = \frac{\dot{V}_i}{Z}e^{-\gamma z} - \frac{\dot{V}_r}{Z}e^{\gamma z} = \dot{I}_i e^{-\gamma z} + \dot{I}_r e^{\gamma z}$$

$$Z = \sqrt{\frac{R + j\omega L}{G + j\omega C}},\ \gamma = \alpha + \beta,\ \alpha = \frac{R}{2}\sqrt{\frac{C}{L}} + \frac{G}{2}\sqrt{\frac{L}{C}},\ \beta = \omega\sqrt{LC}$$

where $I_i$, $V_i$: a current value and a voltage value of a traveling wave

Ir, Vr: a current value and a voltage value of a reflected wave

γ: propagation constant

α: attenuation constant

β: phase constant

Z: characteristic impedance

R: series resistance

L: series inductance

G: parallel conductance

C: capacitance.

A current value on a distributed constant line is inversely proportional to the characteristic impedance. A characteristic impedance of a coplanar type line is given as follows:

$$Z_0 = \frac{\eta_0}{4\sqrt{\varepsilon_{eff}}} \times \frac{K'(k)}{K(k)}$$

where $\epsilon_{eff}$ represents an effective dielectric constant of a coplanar type line, $\eta_0$ a wave impedance in the free space, K(k) a perfect elliptic integral of first type, and' a derivative.

$\epsilon_{eff}$, $\eta_0$ and K(k) are represented as follows:

$$\varepsilon_{eff} = 1 + \frac{\varepsilon_r - 1}{2} \times \frac{K'(k)}{K(k)} \times \frac{K(k_1)}{K'(k_1)}$$

$$\eta_0 = \sqrt{\frac{\mu_0}{\varepsilon_0}} = 120\pi$$

$$K(k) = \int_0^1 \frac{dx}{\sqrt{(1-x^2)\times(1-k^2x^2)}}$$

$$k = \frac{w}{d}$$

$$k_1 = \frac{\sin h(\pi w/4h)}{\sin h(\pi d/4h)}$$

A characteristic impedance $Z_0$ is determined by k, the dielectric constant $\epsilon_r$ of a dielectric substrate and the thickness h of the dielectric substrate. In this manner, by changing the ratio k of the center conductor line width $w_1$ with respect to the ground conductor spacing $d_1$ in a suitable manner, the characteristic impedance can be changed.

EMBODIMENT 2

In consideration of the above, another embodiment of the present invention will be described. With an intent to reduce the maximum current density of resonators which define a coplanar waveguide filter, an investigation has been made into the use of an increased characteristic impedance of a resonator. By way of example, a combination of a resonator having a characteristic impedance of 100Ω with a first input/output terminal section 4*a* having a characteristic impedance of 50Ω, for example, is considered. The filter shown in FIG. 5 which has been described above includes the first input/output terminal section 4*a* having a characteristic impedance of 50Ω, and when a resonator has a characteristic impedance of 100Ω, assuming a ground conductor spacing $d_{io}$ of 0.4 mm and a center conductor line width $w_{io}$ of 0.218 mm for the first input/output terminal section 4*a*, it follows that the resonator would have a ground conductor spacing $d_1$ of 1.780 mm and a center conductor line width $w_1$ of 0.218 mm.

Figure 1:
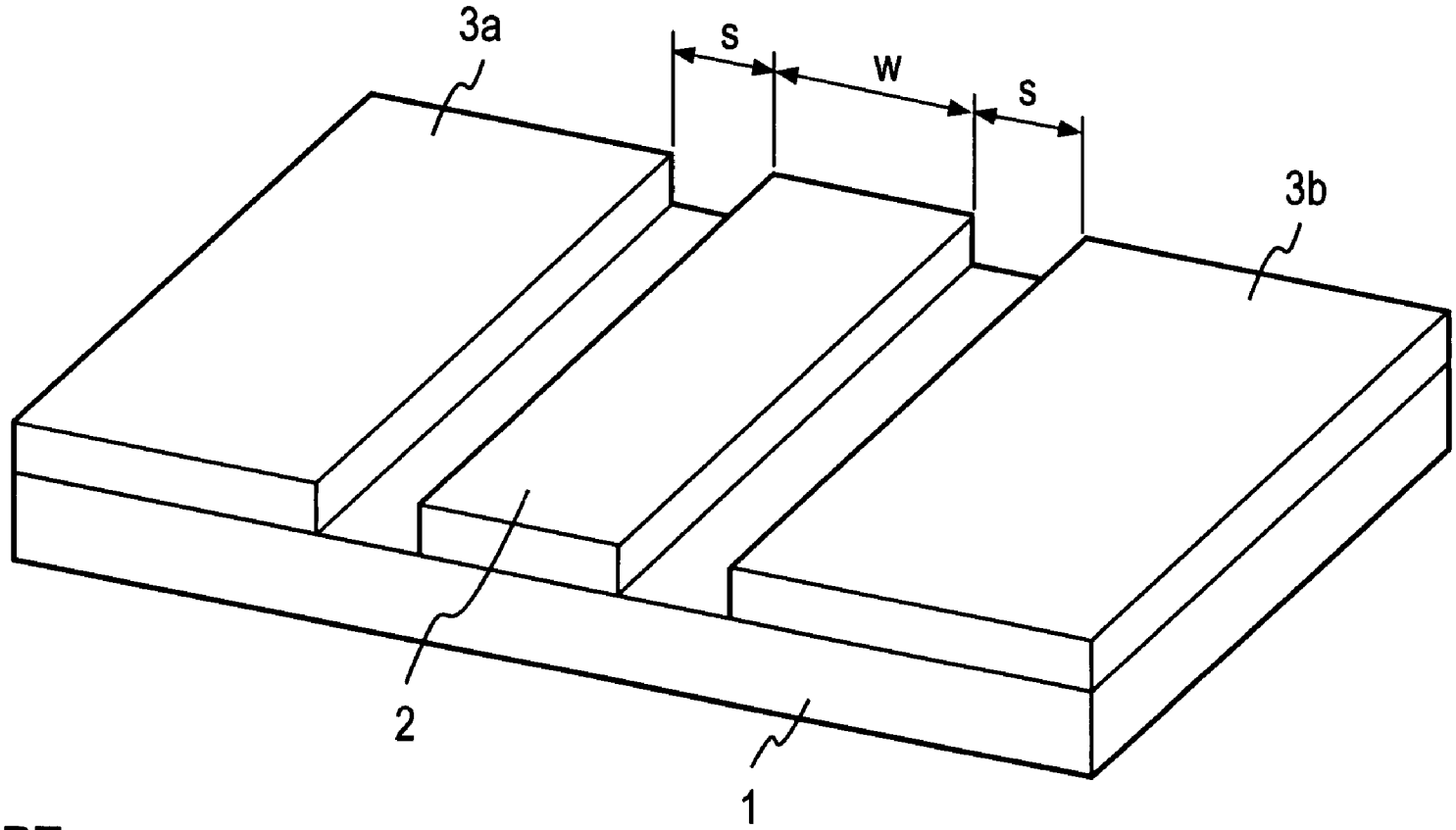
PRIOR ART FIG. 1
FIG. 1 is a perspective view illustrating the concept of a coplanar line.
Figure 3:
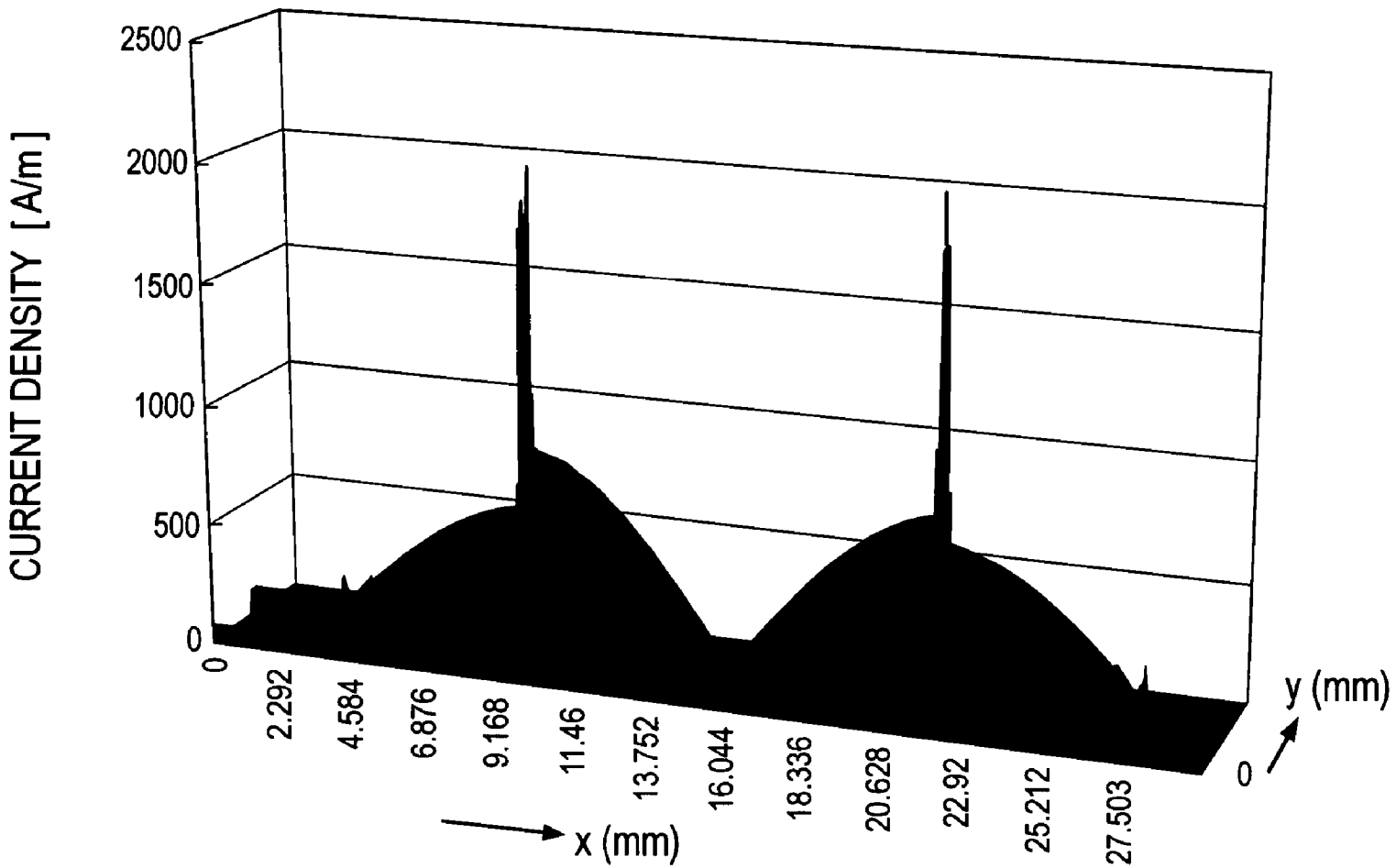
PRIOR ART FIG. 3
FIG. 3 graphically shows a current density distribution of a conventional coplanar waveguide filter.
Figure 4:
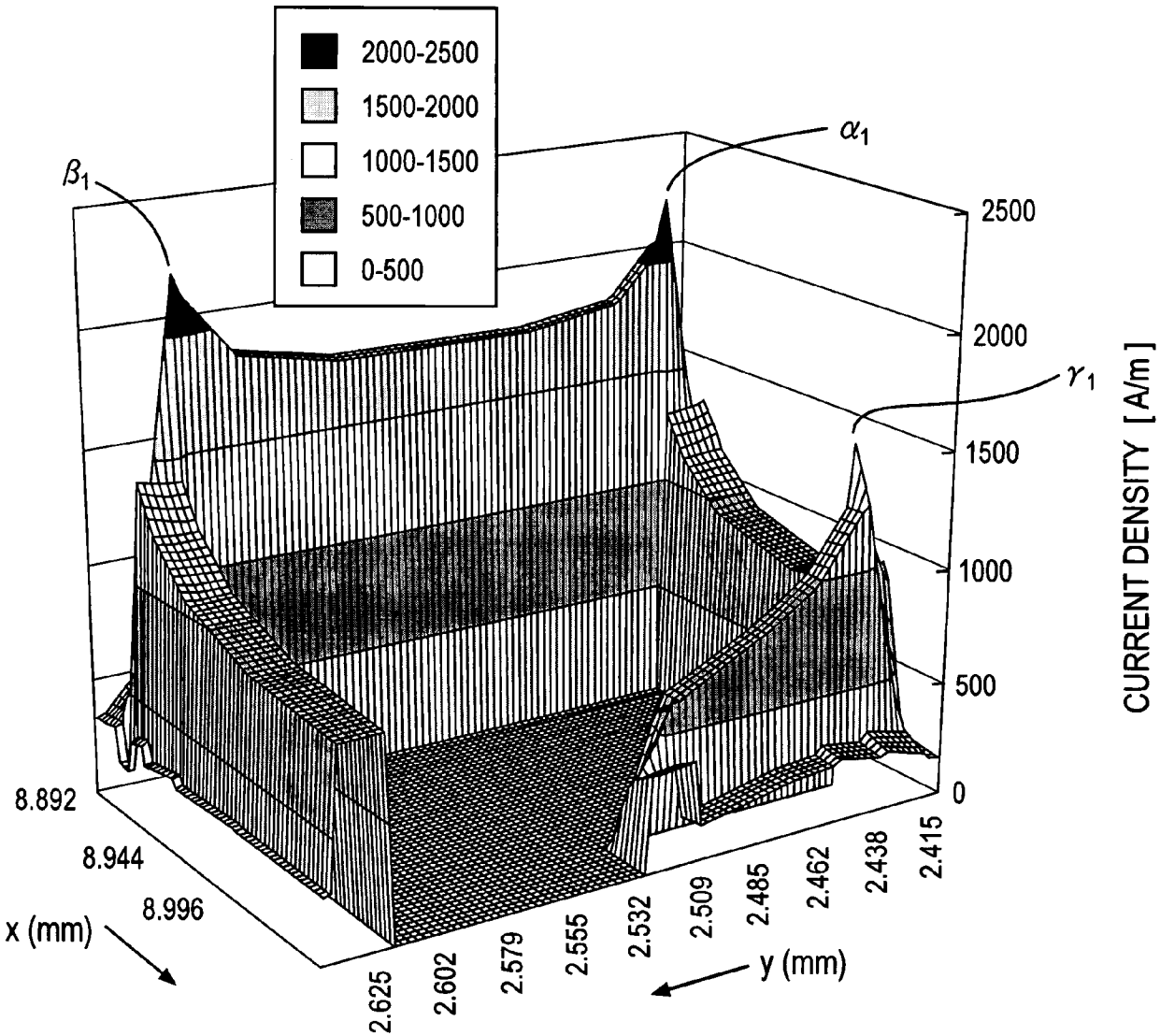
PRIOR ART FIG. 4
FIG. 4 graphically shows a current density distribution of an inductive coupler in a conventional coplanar waveguide filter.
Figure 8:
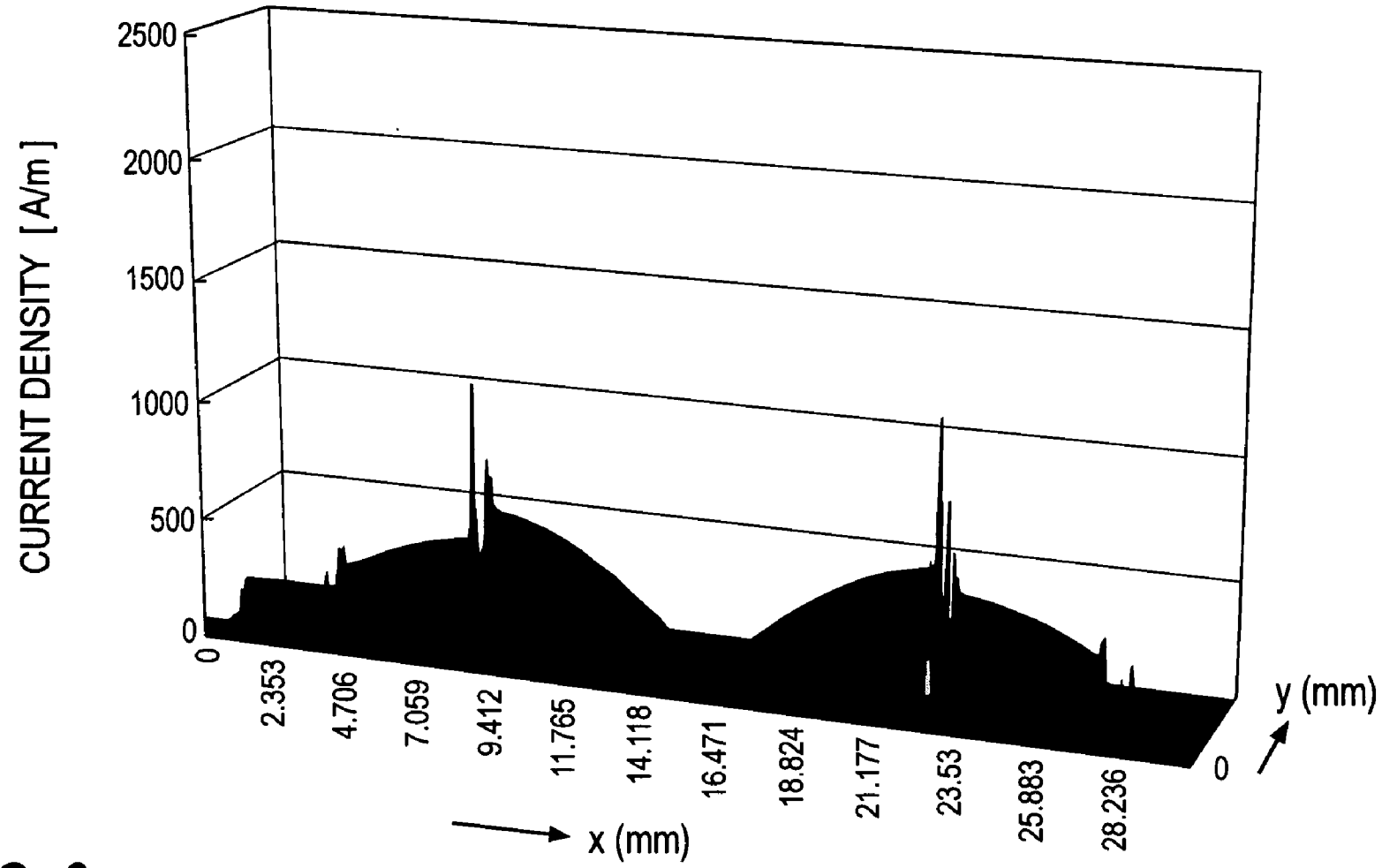
FIG. 8 graphically shows a current density distribution of the one-quarter wavelength four stage coplanar waveguide filter shown in FIG. 5.
Figure 9:
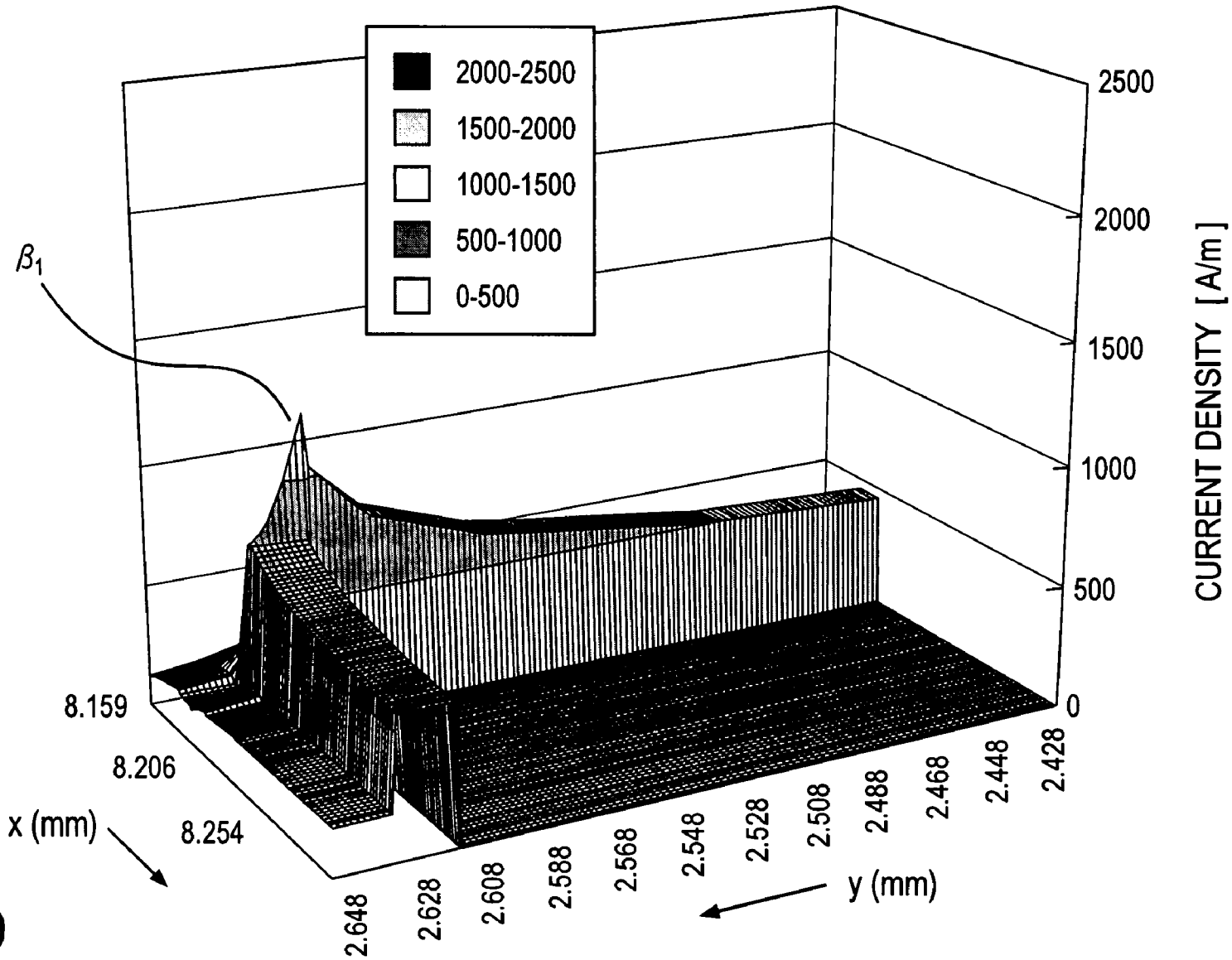
FIG. 9 graphically shows a current density distribution of the inductive coupler in the one-quarter wavelength four stage coplanar waveguide filter shown in FIG. 5.

A result of simulation performed for a current density distribution in one-quarter wavelength four stage coplanar waveguide filter of this numerical example is graphically shown in FIG. 8, which corresponds to FIG. 4. The current density is at its maximum at a first inductive coupler 8*a* which is located at a distance of about 8.0 mm from the input end of the coplanar line and also at a second inductive coupler 8*b* which is located at a distance of about 22 mm from the input end. The peak of the current density is about 1200 A/m, which is considerably reduced as compared with a peak shown in FIG. 3 which is slightly less than about 2200 A/m. FIG. 9 graphically shows a current density distribution of the first inductive coupler 8*a* to an enlarged scale in a manner corresponding to FIG. 4. A position at a distance of 8.159 mm from the signal input end of the first input/output terminal section 4*a* lies on the shorting line conductor 7*a*1, and corresponds to a portion indicated by line IX-IX shown in FIG. 5. Thus, an X-axis position which is stepped back about 0.02 mm from the lateral edge of the shorting line conductor 7*a*1 which is disposed toward the resonator 5*b* represents the position of 8.159 mm shown in FIG. 9. FIG. 9 graphically shows a current density distribution in a range from this position and extending about 0.1 mm toward the output. It will be seen that a current concentration occurs at a corner β where the shorting line conductor 7*a*1 contacts the center conductor line $\mathbf{2}_{R2}$. There is no other corner where a current concentration occurs in FIG. 9. In this manner, with this embodiment, the number of peaks in the current density is reduced. The single peak has a value of about 1200 A/m, which is reduced to a magnitude which is about 55% of a conventional value. The reason why the number of peaks is reduced is because the number of corners where the current concentration occurs is reduced as a result of the fact that rectangular cuts 20 into the ground conductors which were present in the prior art do not exist in this embodiment. A reduction in the peak current density represents an effect of increasing the characteristic impedance of the resonator to 100Ω.

With this embodiment, the current density in each of the resonators 5*a* to 5*b* is reduced, and the maximum current density is reduced by as much as 45% in comparison to FIGS. 3 and 4, which is converted into a power reduction of about 70%.

It should be noted that using the characteristic impedance of the resonator which is equal to 100Ω produces a mismatch of the characteristic impedance at the first and the second input/output terminal section 4*a* and 4*b*. In this respect, for the first input/output terminal section 4*a*, the first capacitive coupler 6*a* connected between the first input/output terminal section 4*a* and the first resonator 5*a* acts as an impedance converter preventing a reflection loss from occurring. Similarly, for the second input/output terminal section 4*b*, the third capacitive coupler 6*c* acts as an impedance converter.

Figure 10:
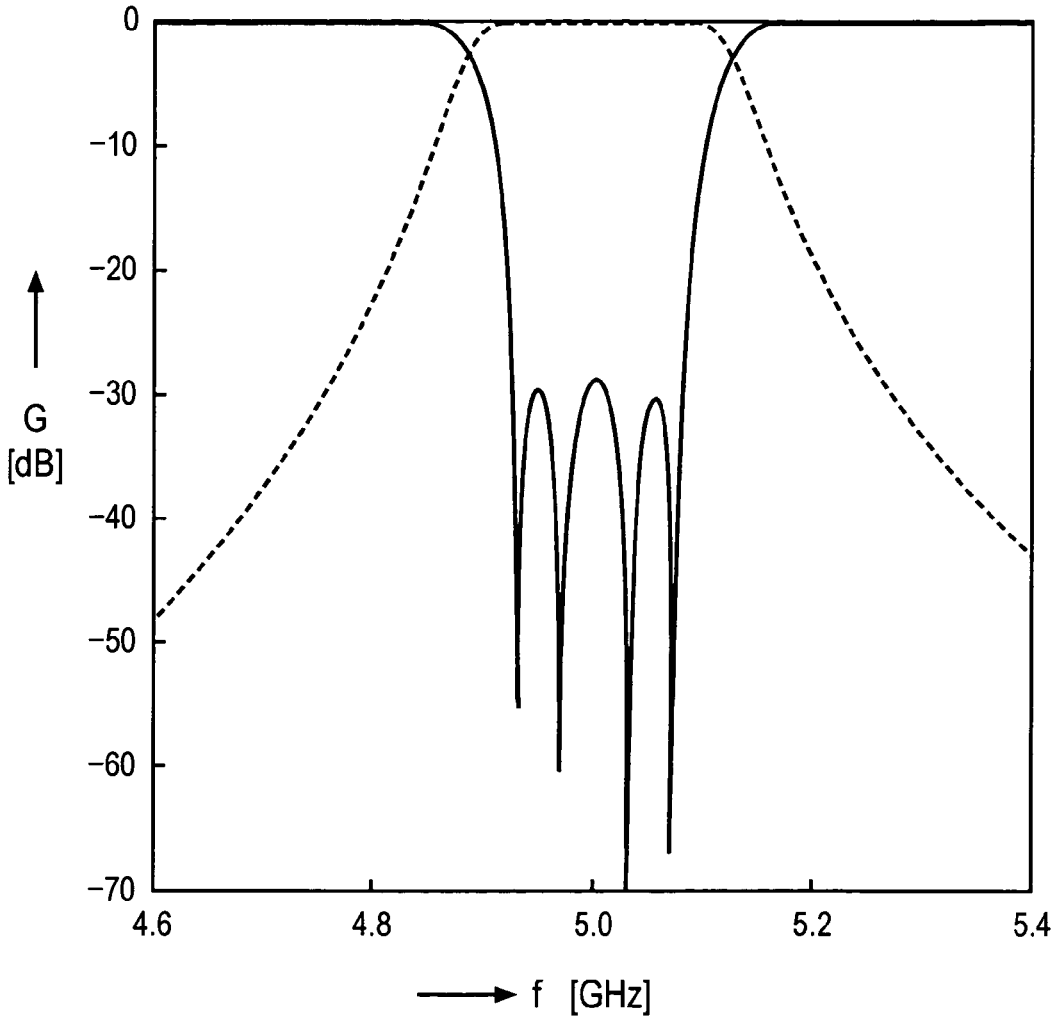
FIG. 10 graphically shows an exemplary frequency response of the one-quarter wavelength four stage coplanar waveguide filter according to the first mode.

FIG. 10 shows a frequency response of the coplanar waveguide filter shown in FIG. 5. In FIG. 10, the abscissa represents a frequency f and the ordinate a gain G. In FIG. 10, broken lines indicate a passband of the filter, and a solid line indicates an amount of signal reflection within the passband. From the fact that the maximum reflection within the breadth of the passband is as small as −30 dB, it is seen that there is no loss caused by a difference in the characteristic impedance between the first and the second input/output terminal section 4*a* and 4*b* and the resonators 5*a* to 5*d*.

Figure 11:
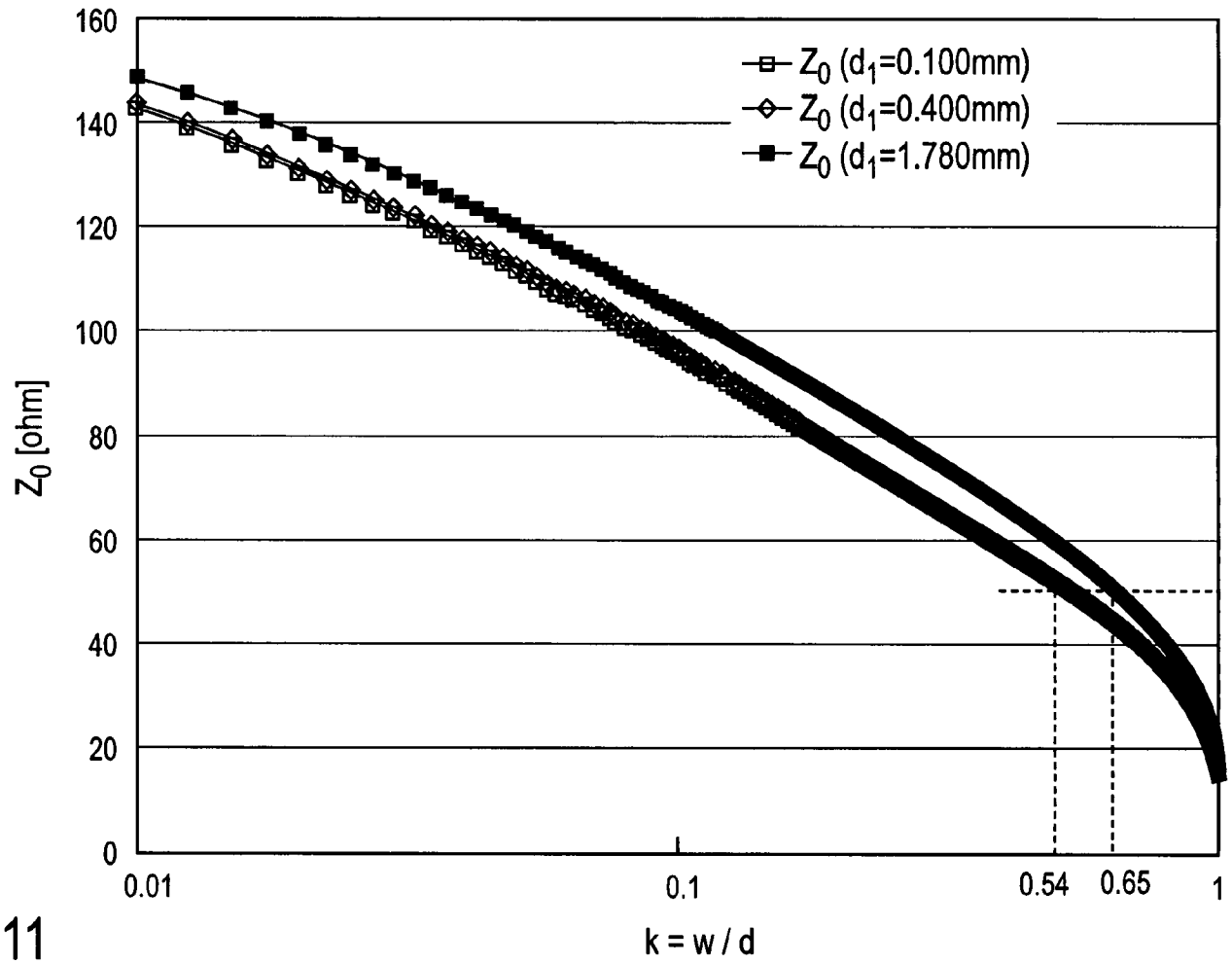
FIG. 11 graphically shows an exemplary characteristic impedance plotted against the ratio k of the center conductor line width with respect to the ground conductor spacing in the filter according to the first mode of carrying out the invention.

In the above description, the characteristic impedance of the resonator is assumed to be 100Ω as contrasted to the characteristic impedance of the first and the second input/output terminal section 4*a* and 4*b* which is equal to 50Ω, but it should be understood that the present invention is not limited to this combination of characteristic impedances. For example, the choice of a characteristic impedance of 150Ω for the resonator with respect to the characteristic impedance of 50Ω of the input/output terminal section is readily possible by suitably changing the ratio k of the center conductor line width $w_1$ with respect to the ground conductor spacing $d_1$. FIG. 11 graphically shows a change in the characteristic impedance $Z_0$ when the ratio k of the center conductor line width $w_1$ with respect to the ground conductor spacing $d_1$ or $k=w_1/d_1$ is changed. In FIG. 11, the abscissa represents k in a logarithmic scale, and the ordinate represents the characteristic impedance $Z_0$, using $d_1$ as a parameter. When $d_1$ equals 0.100 mm, the characteristic curve is substantially identical as when $d_1$ equals 0.400 mm. When $d_1$ equals 1.780 mm, $Z_0$ assumes a slightly higher value. It is possible to establish a characteristic impedance of 50Ω for a range of k from 0.54 to 0.65, a characteristic impedance of 100Ω for a value of k around 0.1 and a characteristic impedance of 140Ω or greater for a value of k equal to 0.01.

In this manner, by reducing the value of k, it is possible to increase the characteristic impedance. However, simply increasing the characteristic impedance does not assure that the maximum current density can be reduced. As shown in FIG. 6 which has been described above, the maximum current density assumes its smallest value in a range of k from approximately 0.25 to 0.55. Accordingly, what is required is not simply reducing k to increase the characteristic impedance. It is seen from FIG. 6 that the maximum current density increases sharply when k is reduced to approximately 0.1 or less. In view of the showing in FIG. 11 that the characteristic impedance is on the order of 100Ω for a value of k around 0.1, it is seen that the effect of reducing the maximum current density diminishes if the characteristic impedance is chosen to be greater than 100Ω. From above, it is preferred that k be chosen to be about 0.08 or greater and the impedance be set up at 100Ω or less.

Figure 12:
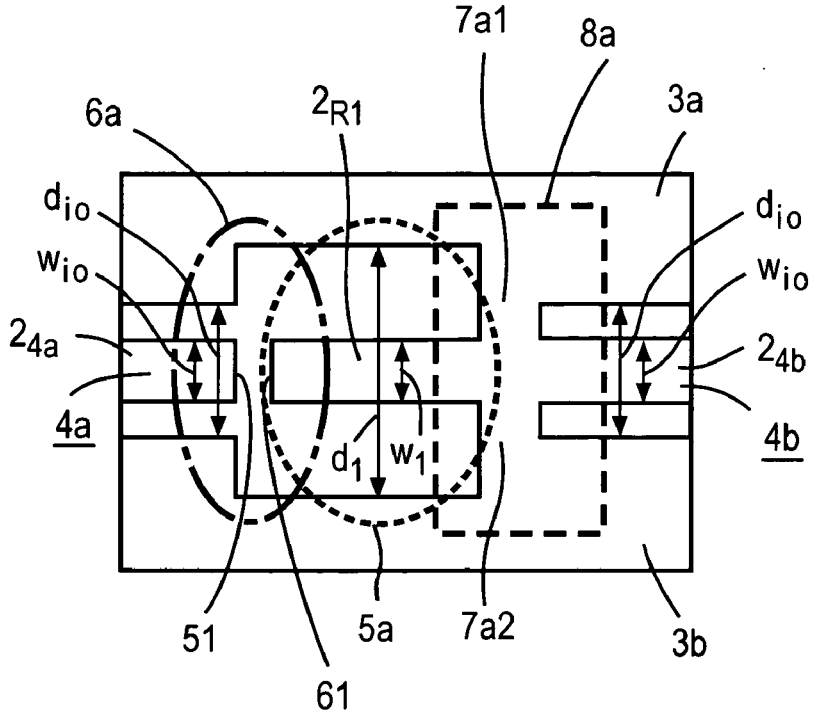
FIG. 12 is a plan view of an embodiment in which the first mode of carrying out the invention is applied to a single stage resonator filter.

In the present embodiment, an example has been described in which the four resonators are connected in series, but it should be understood that the number of resonators are not limited to four. Even a single stage of resonator can function as a filter. For a single stage resonator, for example, the reflection response indicated by a solid line in the frequency response shown in FIG. 10 will be sharply attenuated only at one location and the passband response indicated by broken lines will be a narrow response having an abrupt peak at a frequency where the reflection response exhibits a sharp attenuation. In this manner, the single stage resonator functions as a filter even though the passband becomes narrower. An example of a filter which is formed by a single stage resonator is shown in FIG. 12. One end of a center conductor line $\mathbf{2}_{R1}$ of a first resonator 5*a* is coupled to a first input/output terminal section 4*a* by a first capacitive coupler 6*a*, and the other end of the center conductor line $\mathbf{2}_{R1}$ is coupled to a second input/output terminal section 4*b* through a first inductive coupler 8*a*. The center conductor line width $w_{io}$ of the first and the second input/output terminal section 4*a* and 4*b* and the center conductor line width $w_1$ of the resonator 5*a* are chosen to be equal to each other while the ground conductor spacing $d_1$ of the resonator 5*a* is chosen to be greater than the ground conductor spacing $d_1$ of the first and the second input/output terminal section 4*a* and 4*b*. The capacitive coupling end 51 of the first capacitive coupler 6*a* which is disposed toward the input/output terminal section 4*a* represents a simple extension of the center conductor line $\mathbf{2}_{4a}$, and a capacitive coupling end 61 disposed toward the center conductor line $\mathbf{2}_{R1}$ and which opposes the coupling end 51 is directly defined by the center conductor line $\mathbf{2}_{R1}$ itself. Accordingly, the first capacitive coupler 6*a* has a strength of coupling which is less than that of the first capacitive coupler 6*a* shown in FIG. 5.

The center conductor line $\mathbf{2}_{4b}$ of the second input/output terminal section 4*b* is directly connected with shorting line conductors 7*a*1 and 7*a*2. The resonator 5*a* and the second input/output terminal section 4*b* are coupled together by the inductive coupler 8*a*. The coupling between the resonator and the input/output terminal section is set up in accordance with a balance of a design for the strength of coupling, and may comprise either a capacitive or an inductive coupling.

As will be understood from the description of a filter response of a single resonator filter, when a plurality of resonators are used, for example, in the example shown in FIG. 5, by adjusting the coupling between adjacent ones of the resonators 5*a* to 5*d*, an overall required passband width as shown in FIG. 10 is obtained.

In this mode of carrying out the invention, the center conductor line 2 and the first and the second ground conductor may be formed of a lanthanum-, yttrium-, bismuth-, thalium- and other high temperature superconductor to define a superconducting waveguide filter. Since it has become possible to reduce the maximum current density in accordance of the invention, the likelihood that there occurs a current flow in excess of a critical current for a high temperature superconductor is minimized, allowing a low loss effect of a superconducting coplanar waveguide filter to be fully exercised without accompanying a destruction of the superconducting coplanar waveguide filter. The center conductor line width and the ground conductor spacing can be previously chosen to avoid a current flow in excess of a critical current for a high temperature superconductor at the demanded maximum current density by referring to FIG. 6, for example.

SECOND MODE OF CARRYING OUT THE INVENTION

A second mode of carrying out the invention will now be described in which a characteristic impedance is maintained constant and the center conductor line width $w_1$ of a resonator is made greater than the center conductor line width $w_{io}$ of an input/output terminal section to reduce a current density.

Figures 13A, 13B, 13C:
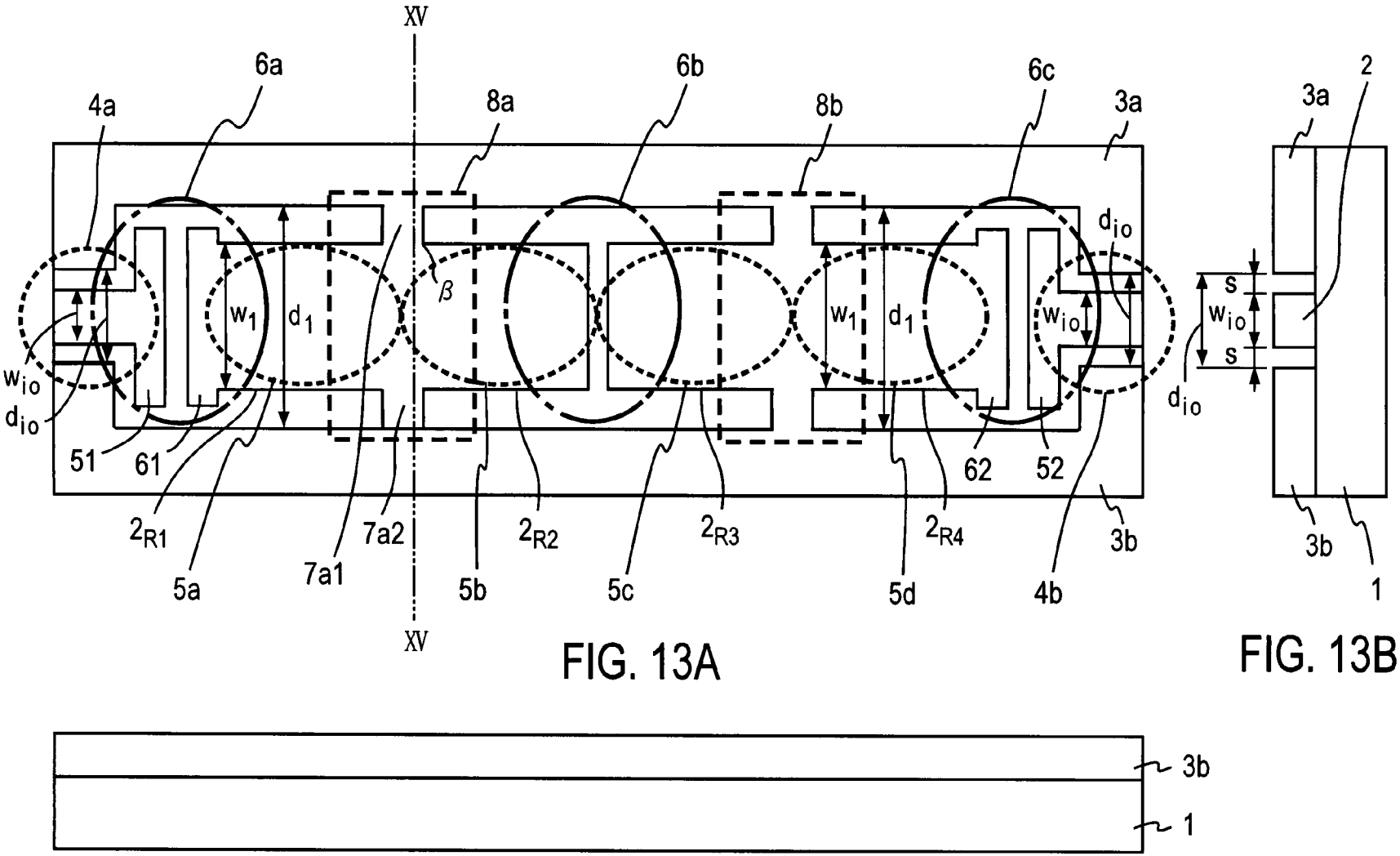
FIG. 13A is a plan view of an example in which a second mode of carrying out the present invention is applied to one-quarter wavelength four stage coplanar waveguide filter.
FIG. 13B is a right-hand side elevation of FIG. 13A.
FIG. 13C is a front view of FIG. 13A.

The second mode of carrying out the invention is illustrated in FIGS. 13A to 13C. In this example, four one-quarter wavelength coplanar resonators 5*a* to 5*d* are connected in series and this example is distinct from the prior arrangement shown in FIG. 2 in that the center conductor line width $w_1$ and the ground conductor spacing $d_1$ of each of the resonators 5*a* to 5*d* are greater than the center conductor line width $w_{io}$ and the ground conductor spacing $d_{io}$ of each of input/output terminal sections 4*a* and 4*b*. However, the characteristic impedance from the first input/output terminal section 4*a* which represents a signal input terminal, through the individual resonators to the second input/output terminal section 4*b* which represents a signal output terminal assumes a constant value, which is chosen to be 50Ω, in this example. In the first and the second capacitive coupler 6*a* and 6*c* which are disposed at the input and the output end, capacitive coupling ends 51 and 52 which are disposed adjacent to center conductors $\mathbf{2}_{4a}$ and $\mathbf{2}_{4b}$ are extended in opposite crosswise directions of the center conductors and are disposed parallel to and closely oppose capacitive coupling ends 61 and 62 of the resonators to strengthen the coupling in the similar manner as in the embodiment shown in FIG. 5. Rectangular cuts 20 shown in FIG. 2 are formed in none of a first and a second ground conductor 3*a* and 3*b* in a first and a second inductive coupler 8*a* and 8*b*. To give a specific numerical figure, the center conductor line width $w_1$ which forms the resonator is chosen to be 1.164 mm in this example as contrasted to 0.218 mm in FIG. 5.

Figure 14:
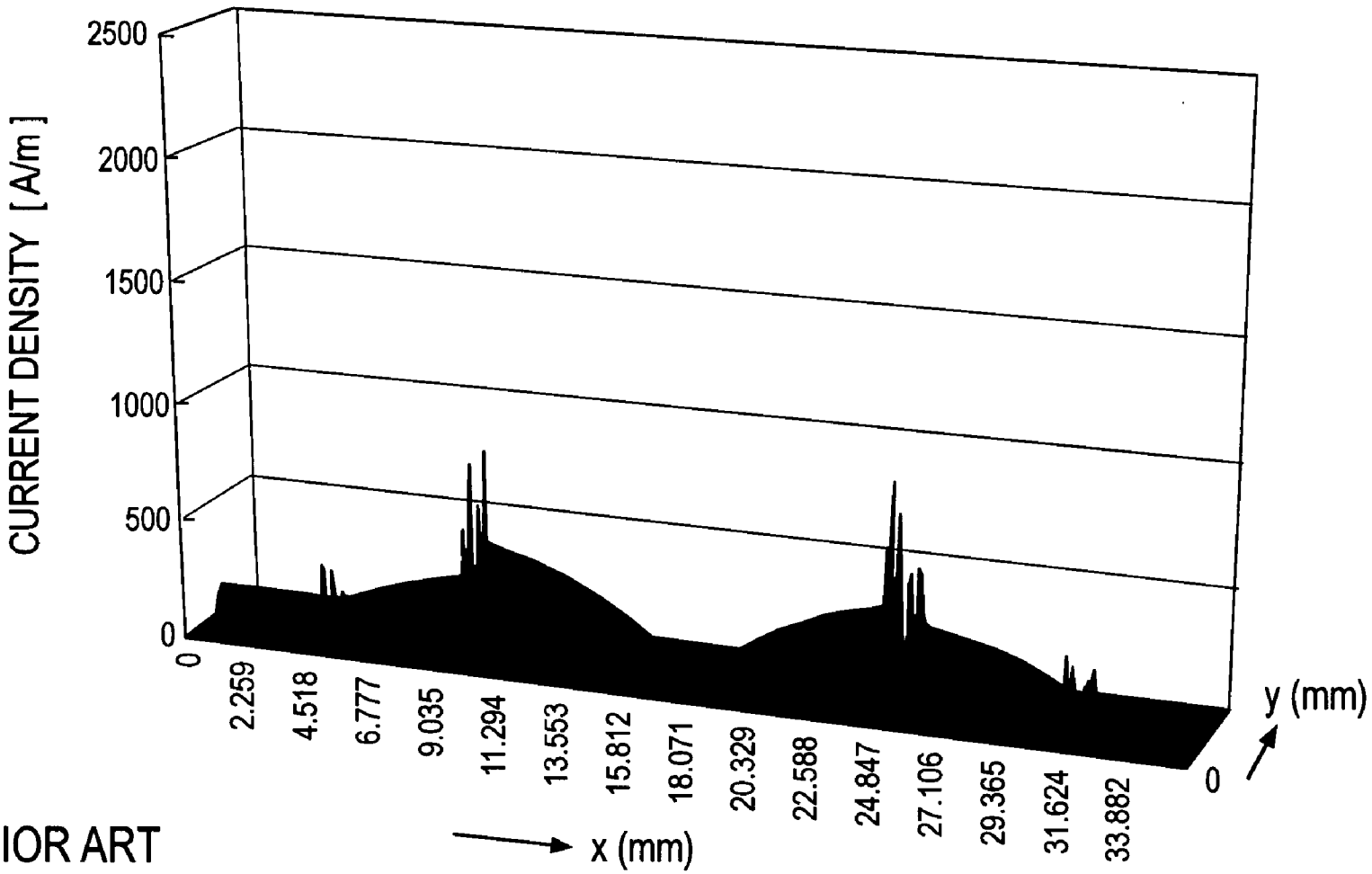
PRIOR ART FIG. 14
FIG. 14 graphically shows a current density distribution of the one-quarter wavelength four stage coplanar waveguide filter shown in FIG. 13.
Figure 15:
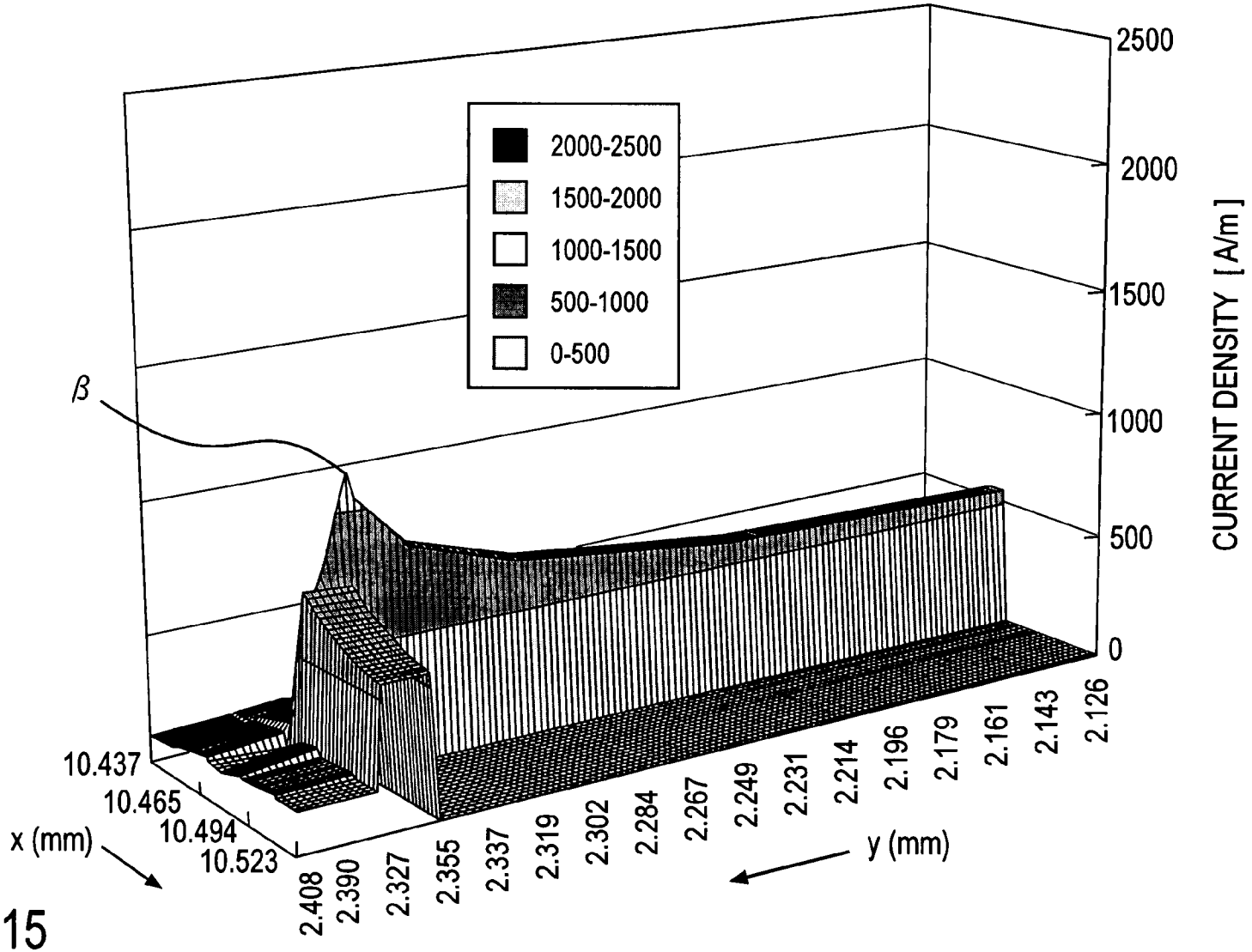
FIG. 15 graphically shows a current density distribution of the inductive coupler in the one-quarter wavelength four stage coplanar waveguide filter shown in FIG. 13.

A current density distribution of the one-quarter wavelength four stage coplanar waveguide filter according to the second mode of carrying out the present invention is graphically shown in FIG. 14, which corresponds to FIG. 3. The current density is at its maximum at the first inductive coupler 8*a* which is located at a distance of about 10 mm from the input of the coplanar line and at the second inductive coupler 8*b* which is located at a distance of about 25 mm from the input. The peak of the current density is about 1100 A/m which is considerably reduced from the peak shown in FIG. 3. FIG. 15 graphically shows a current density distribution of the first inductive coupler 8*a* to an enlarged scale, in a manner which corresponds to FIG. 4. A position shown in FIG. 15 at 10.437 mm represents an X-axis position corresponding to a line XV-XV shown in FIG. 13 which is reached when stepped back by about 0.02 mm toward the input from the lateral edge of the shorting line conductor 7*a*1 which is disposed toward the resonator 5*b*. FIG. 15 shows a current density distribution in a region from this position and extending toward the output by 0.1 mm. It will be noted that there is a current concentration at a corner β which is a junction between the shorting line conductor 7*a*1 and a center conductor line $\mathbf{2}_{R2}$. The peak reaches about 1100 A/m. There is no other peak or concentrated current density except for this. A comparison will be considered between FIG. 14 showing the current density distribution at the first inductive coupler 8*a* which is described above in connection with the prior art and the current density distribution at the first inductive coupler 8*a* of the second mode of carrying out the present invention. Initially, it will be noted that the number of peaks in the current density is reduced in the present example. The peak has a value of about 1100 A/m, which is suppressed to the order of about 50%. A reduction in the number of peaks is attributable to the absence in the present example of rectangular cuts 20 into the ground conductors which are used in the prior art. A reduction in the peak of current density represents an effect of increased center conductor line width $w_1$.

It will be seen that if the characteristic impedance were maintained constant at 50Ω, the current density in each resonator is reduced by increasing the center conductor line width $w_1$, the reduction in the maximum current density amounting to about 50%, which is equivalent to a reduction in the power as much as about 75%.

Figure 16:
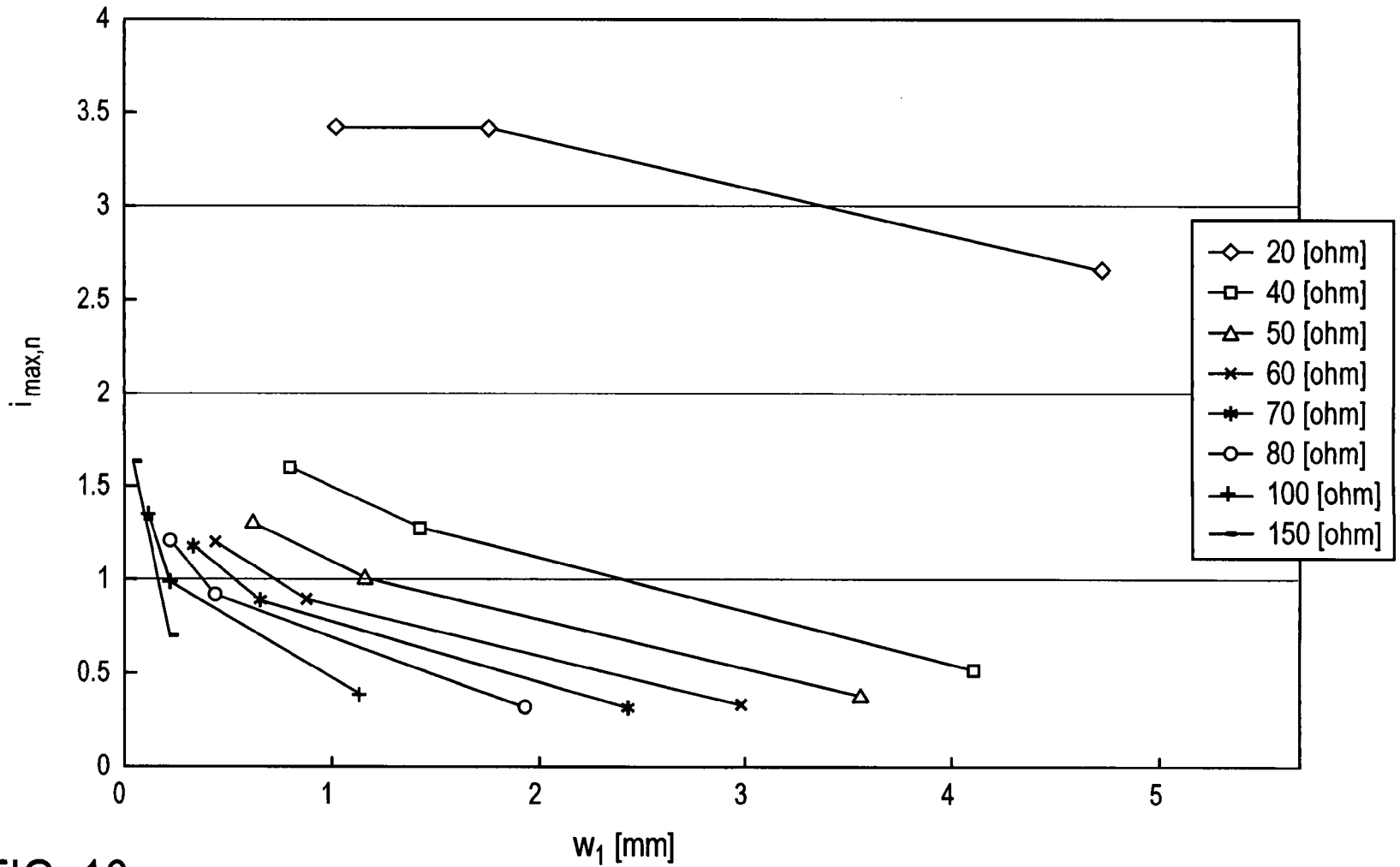
FIG. 16 graphically shows a maximum current density imax, n plotted against the center conductor line width $w_1$.

The maximum current density plotted against the center conductor line width $w_1$ when the characteristic impedance is maintained constant is graphically shown in FIG. 16. In FIG. 16, the abscissa represents the center conductor line width $w_1$, and the ordinate represents a maximum current density $i_{max}$ for each characteristic impedance line which is normalized by the maximum current density on the 50Ω characteristic impedance line with a center conductor line width $w_1$ equal to 1.16 mm. Responses are shown for characteristic impedances of 20, 40, 50, 60, 70, 80, 100 and 150Ω as a parameter. It will be noted that the responses are such that the maximum current density becomes reduced as the center conductor line width $w_1$ is increased.

Since 50Ω is used generally for the characteristic impedance, the extent to which the center conductor line width $w_1$ of the resonator can be extended from the center conductor line width $w_{io}$ of the first input/output terminal section 4*a* when the characteristic impedance of 50Ω is used from the first input/output terminal section 4*a* to the second input/output terminal section 4*b* can be determined from FIG. 11. Because the first input/output terminal section 4*a* has a k which is equal to 0.54 when the first input/output terminal section 4*a* has a ground conductor spacing $d_{io}$ of 0.4 mm and a center conductor line width $w_{io}$ of 0.218 mm, by choosing a k of the resonator in a range $0.54<k\leqq 0.65$, there can be obtained from FIG. 11 a current density reducing effect by increasing the center conductor line width $w_1$.

As mentioned above, in accordance with the invention, the current density can be reduced below the maximum current density of the coplanar filter of the prior art in which the ground conductor spacing and the center conductor line width of the resonator are chosen to be equal to the ground conductor spacing and the center conductor line width of the input/output terminal section.

While the present invention has been described above by choosing a maximum value of the ground conductor spacing $d_1$ at 1.780 mm and a maximum value of the center conductor line width $w_1$ at 1.308 mm, it should be understood that the present invention is not limited to these numerical figures. In accordance with the invention, a preferred filter design is made possible by choosing a ratio $w_1/d_1$ of the center conductor line width $w_1$ with respect to the ground conductor spacing $d_1$, and accordingly, the invention is not governed by such numerical figures.

Figure 17:
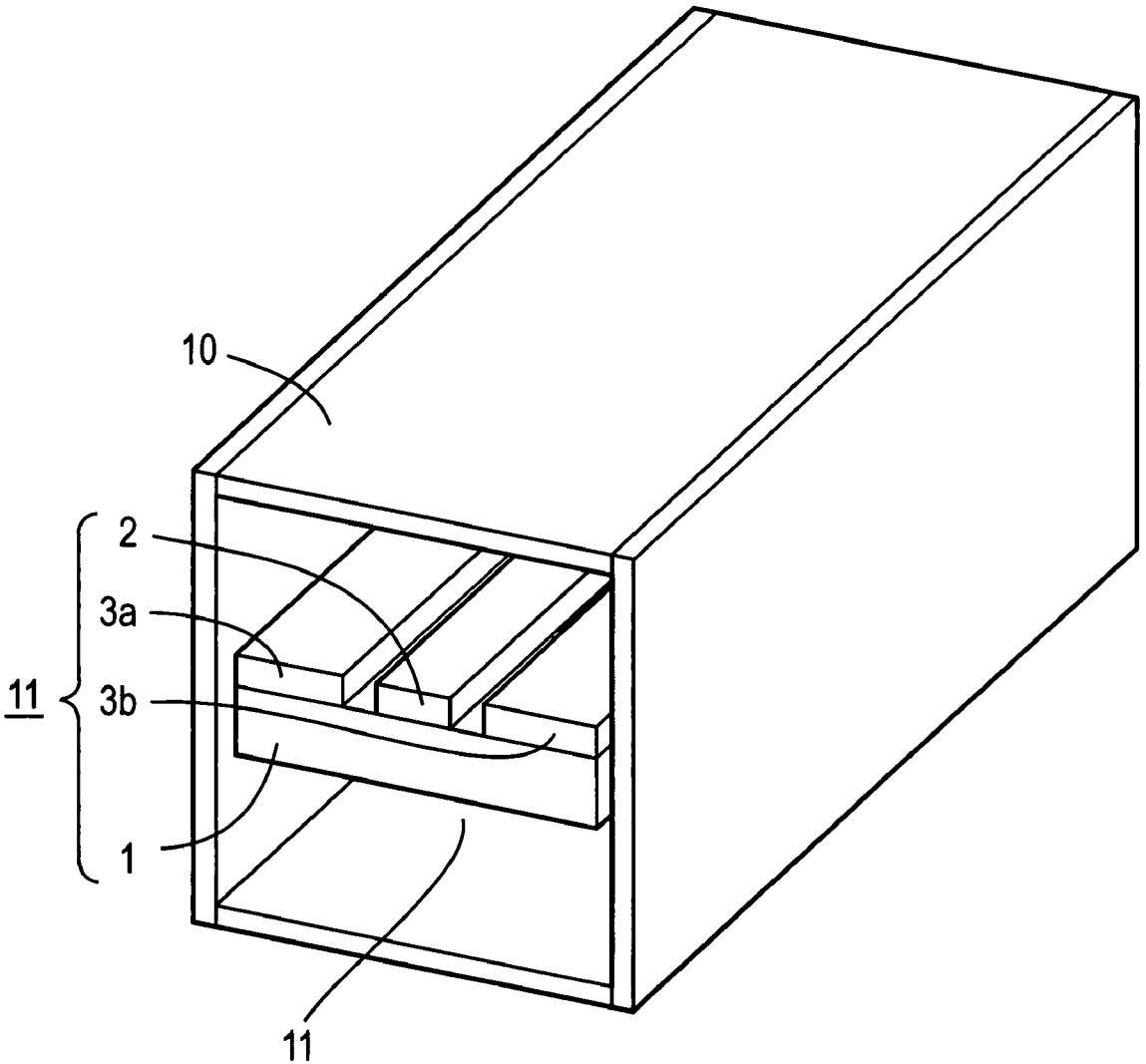
FIG. 17 is a perspective view of an embodiment of a coplanar waveguide filter which is contained in a metal casing.

A coplanar waveguide filter according to a further embodiment of the present invention is shown in FIG. 17. A square tubular metal casing 10 contains a coplanar waveguide filter 11 of any one of the embodiments mentioned above, for example. The coplanar waveguide filter 11 is disposed in opposing relationship with and parallel to one side plate of the casing 10, the internal space of which is substantially halved by the coplanar waveguide filter 11. Electromagnetic power which is radiated from the coplanar waveguide filter 11 is reflected nearly in its entirety by the internal surface of the casing 10, and a majority of the radiated electromagnetic power is recovered by the filter 11, thus alleviating the radiation loss. A coplanar waveguide filter which employs a superconducting material is generally contained within some sort of casing in order to produce a superconducting state.

The present invention is similarly applicable to a transmission line such as a grounded coplanar line, provided it is capable of forming a filter by a suitable design and adjustment of both the characteristic impedance of an input/output terminal section and the characteristic impedance of a resonator formed within the transmission line.

THIRD MODE OF CARRYING OUT THE INVENTION

Figure 18:
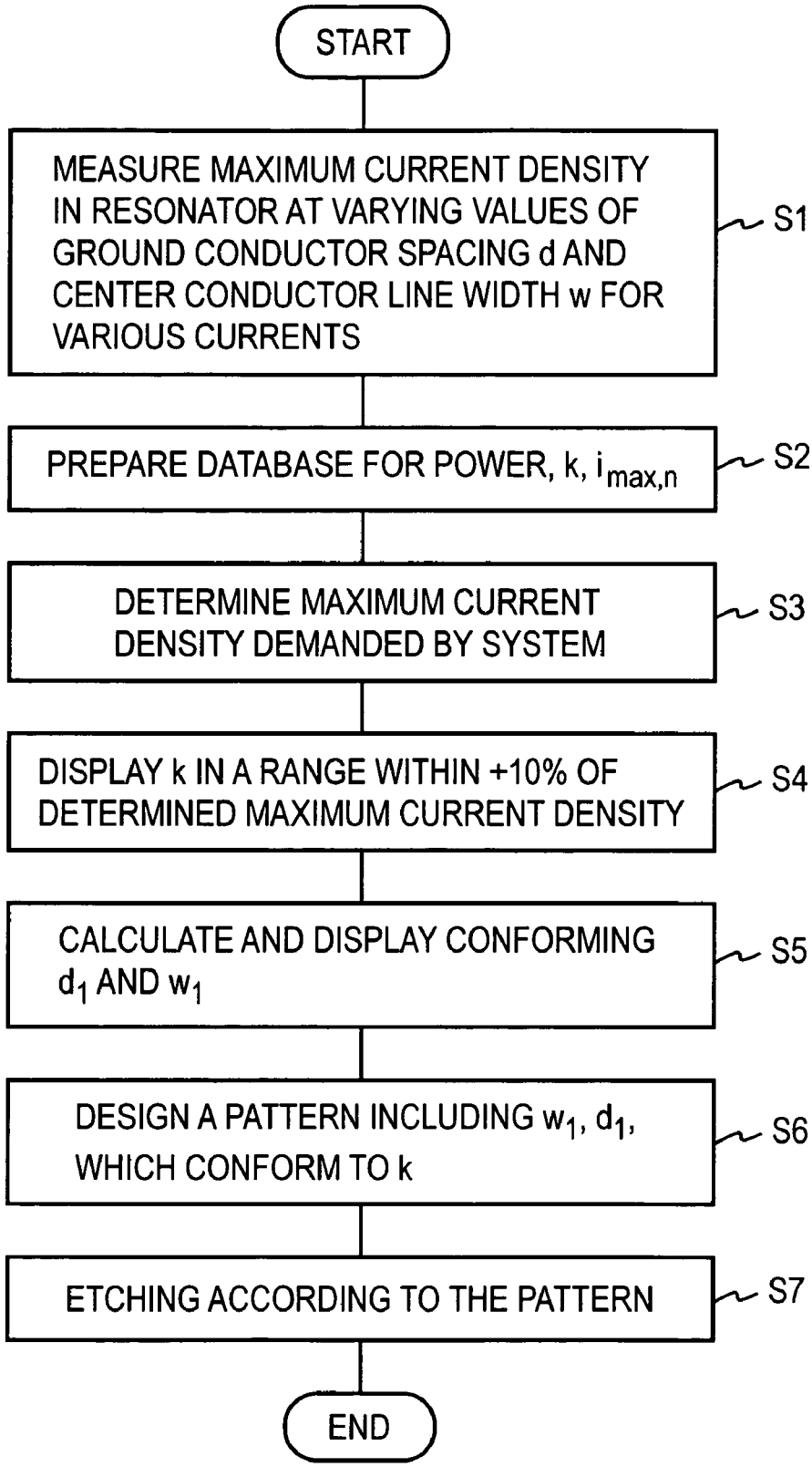
FIG. 18 is a flowchart of an exemplary processing procedure of a mode of carrying out the method of the present invention.
Figure 19:
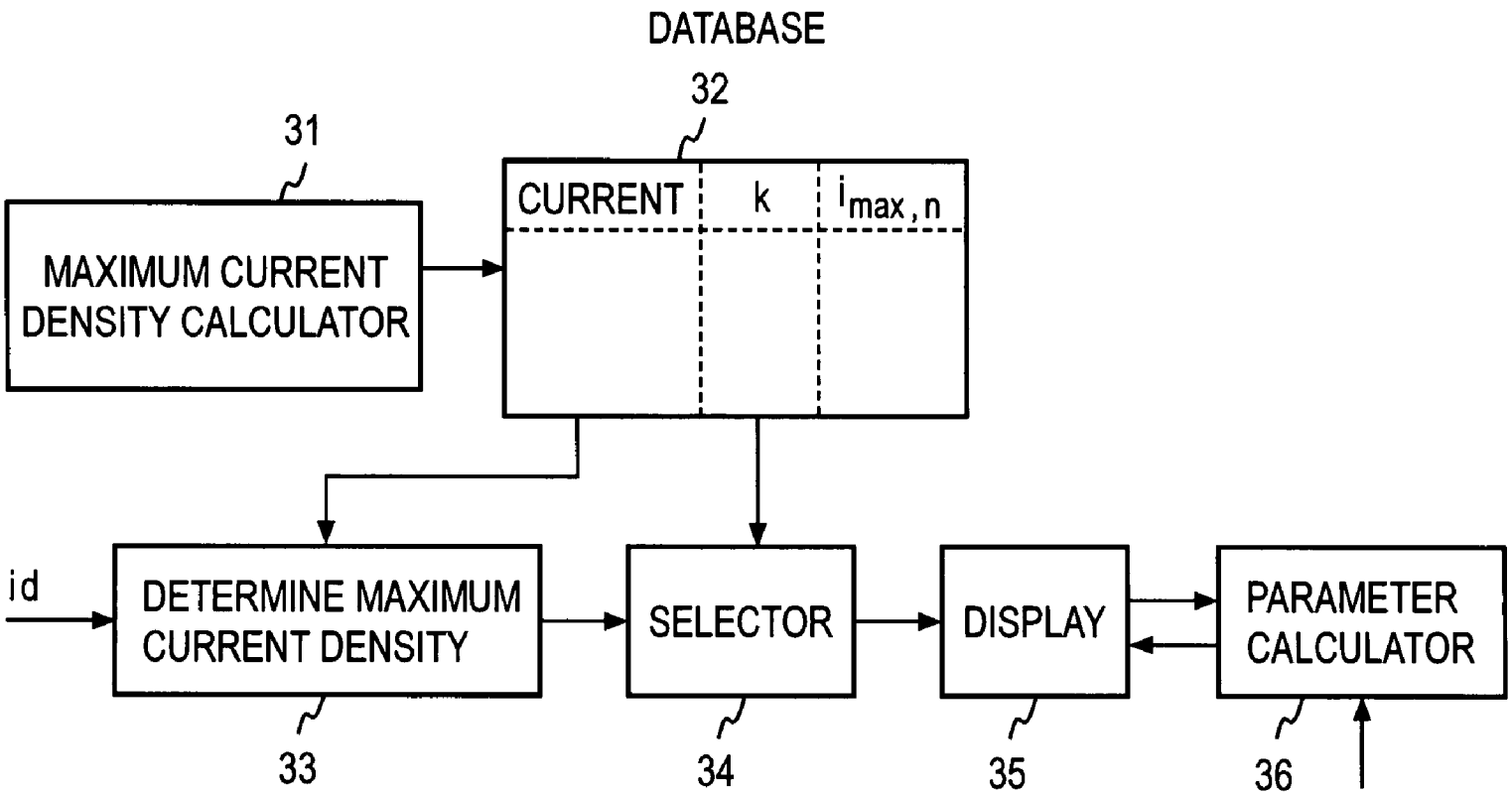
FIG. 19 is a block diagram of an exemplary functional arrangement of an auxiliary unit which is utilized in a part of the processing procedure shown in FIG. 18.

As a third mode of carrying out the present invention, a method of forming a filter according to the present invention will be described. An example of a processing procedure for this mode is shown in FIG. 18, and an exemplary functional arrangement of an auxiliary unit which is used in a part of the procedure is shown in FIG. 19.

For a coplanar resonator 5 having varying values of the ground conductor spacing d1 and the center conductor line width $w_1$, a maximum current density in the resonator 5 is determined with a maximum current density calculator 31 on the basis of currents (powers) demanded in a system in which the coplanar waveguide filter is assumed to be used (step S1).

For a multitude of results of calculation thus obtained, a normalized maximum current density $i_{max,n}$ for each value of the ratio k of the center conductor line width $w_1$ with respect to the ground conductor spacing d1 or $k=w_1/d_1$ is determined in the manner mentioned above in the description of the first mode of carrying out the present invention with reference to FIG. 6, and this correspondence as well as prevailing calculated currents are stored in a database 32 (step S2).

This database 32 is previously prepared.

Accordingly, the method of forming a filter generally starts with obtaining, on the basis of a current $i_d$ which is demanded by a system in which the coplanar waveguide is used, several normalized maximum current densities in the database 32 by means of a maximum current density decision unit 33 (step S3).

A plurality of k's which correspond to ranges of normalized maximum current densities which are equal to or less than 10% higher than the several normalized maximum current densities thus obtained are selected by a selector 34 and displayed on a display 35 (step S4).

For several selected k's, the ground conductor spacing d1 and the center conductor line width $w_1$ are determined by a parameter calculator 36 on the basis of a demanded characteristic impedance, an outer profile size and other conditions, and are displayed on the display 35 (step S5).

A pattern is then designed for a filter, an input/output terminal section and each coupler having the ground conductor spacing $d_1$ and the center conductor line width $w_1$ which are displayed (step S6). Films of conductors on a dielectric substrate are etched so that the designed pattern can be obtained, thus forming a desired coplanar waveguide filter (step S7).

When it is desired to reduce a maximum current density as a system requirement, the characteristic impedance may be increased, and/or the center conductor line width may be reduced. When it is desired to reduce the conductor loss as the system requirement, k may be modified so as to increase the no-load Q of the resonator 5.

In this manner, a filter which conforms to the current demanded by the system can be formed. This is a distinction from the prior art where a maximum current density in a completed filter is determined and then a current (power) which is used in a corresponding system is determined.

What is claimed is:

1. A coplanar waveguide filter comprising:

a dielectric substrate, at least one coplanar waveguide resonator formed on one surface of said dielectric substrate by a first center conductor line and first and second ground conductors which are formed on the dielectric substrate on opposite sides of the first center conductor line, respectively, said first and second ground conductors defining therebetween a first ground conductor spacing, and a coplanar input/output terminal section which is formed on said one surface of the dielectric substrate by a second center conductor and third and fourth ground conductors formed integrally with said first and second ground conductors, respectively, and disposed on opposite sides of the second center conductor, respectively, said third and fourth ground conductors defining therebetween a second ground conductor spacing; and a capacitive coupler formed by end portions of said first and second center conductor lines expanded in width direction thereof and opposed with each other, for making capacitive coupling between the coplanar input/output terminal section and the coplanar waveguide resonator;

wherein one of the first ground conductor spacing and a width of the first center conductor line of the coplanar waveguide resonator is greater than a corresponding one of the second ground conductor spacing and a width of the second center conductor line of the input/output terminal section.

2. A coplanar waveguide filter according to claim 1 in which the filter comprises a plurality of said coplanar waveguide resonators, at least one pair of adjacent coplanar waveguide resonators being coupled together by an inductive coupler, wherein said inductive coupler includes shorting line conductors each having a length which is equal to spacing between the first and second ground conductor and the center conductor line of the coplanar waveguide resonator.

3. A coplanar waveguide filter according to claim 1 in which the first ground conductor spacing of the coplanar waveguide resonator is greater than the second ground conductor spacing of the coplanar input/output terminal section and in which a ratio k of the width of the first center conductor line with respect to the first ground conductor spacing of the coplanar waveguide resonator satisfies a relationship: $0.20 \leqq k \leqq 0.70$.

4. A coplanar waveguide filter according to claim 3 in which the coplanar waveguide resonator has a characteristic impedance which is greater than the characteristic impedance of the coplanar input/output terminal section.

5. A coplanar waveguide filter according to claim 4 in which the capacitive coupler which couples the coplanar input/output terminal section and the coplanar waveguide resonator also serves as an impedance converter which matches the both characteristic impedances.

6. A coplanar waveguide filter according to claim 1 in which the first ground conductor spacing is greater than the second ground conductor spacing, the width of the first center conductor line of the waveguide coplanar resonator being equal to the width of the second center conductor line of the coplanar input/output terminal section, the coplanar waveguide resonator having a characteristic impedance which is greater than the characteristic impedance of the coplanar input/output terminal section.

7. A coplanar waveguide filter according to claim 1 in which the width of the first center conductor line of the coplanar waveguide resonator is greater than at least the width of the second center conductor line of the coplanar input/output terminal section and the coplanar waveguide resonator has a characteristic impedance which is equal to the characteristic impedance of the input/output terminal section.

8. A coplanar waveguide filter according to claim 7 in which a ratio k of the width of the second center conductor line with respect to the second ground conductor spacing of the input/output terminal section is equal to 0.54 while a ratio k of the width of the first center conductor line with respect to the first ground conductor spacing of the coplanar waveguide resonator satisfies the relationship: $0.54 \leqq k \leqq 0.65$.

9. A coplanar waveguide filter according to claim 1 in which the coplanar waveguide resonator and the coplanar input/output terminal section are formed of a superconducting material.

10. A coplanar waveguide filter according to claim 1, further comprising:

a metal casing which contains the dielectric substrate, the coplanar waveguide resonator and the coplanar input/output terminal section.

11. A coplanar waveguide filter according to claim 1 in which a maximum current density of the coplanar waveguide filter is set so as not to exceed a predetermined maximum current density which occurs when the first ground conductor spacing and the width of the first center conductor line of the coplanar resonator are equal to the second ground conductor spacing and the width of the second center conductor line, respectively, of the input/output terminal section.

12. A method of forming a coplanar waveguide filter comprising at least one coplanar waveguide resonator and a coplanar input/output terminal section each of which includes a center conductor line and first and second ground conductors formed on opposite sides of the center conductor line on a surface of a dielectric substrate, comprising the steps of:

(a) determining a demanded maximum current density in the coplanar waveguide filter which is demanded for a system;

(b) determining values of a ground conductor spacing between the first and second ground conductors and a width of the center conductor line which permit the determined value of the demanded maximum current density on the basis of a relationship between a maximum current density and a ratio of a width of the center conductor line with respect to the ground conductor spacing of the resonator; and (c) forming the center conductor line and the first and second ground conductors on the surface of the dielectric substrate on the basis of the determined values of the ground conductor spacing and width of the center conductor line.

13. A method of forming a coplanar waveguide filter according to claim 12 in which in said step (b) the ground conductor spacing and the width of the center conductor line are determined with reference to a database which stores measured relationships between maximum current density and ratio of a width of center conductor line with respect to a ground conductor spacing.

14. A method of forming a coplanar waveguide filter according to claim 12 in which in said step (a) the determined demanded maximum current density has a value within +10% above a smallest value the maximum current density in the relationship between maximum current densities and rate of width of center conductor line with respect to ground conductor spacing for one of a plurality of ground conductor spacing.

15. A method of forming a coplanar waveguide filter according to claim 12 in which the center conductor line and the ground conductors are formed by a superconducting material and in which the system requirement is determined on the basis of a critical current density of the superconducting material.

16. A method of forming a coplanar waveguide filter according to claim 12 in which when the system requirement demands a reduction in the maximum current density, at least one of the characteristic impedance and the center conductor line width is modified.

17. A method of forming a coplanar waveguide filter according to claim 12 in which when the system requirement demands a reduction in the conductor loss, the ratio of the center conductor line width is modified on the basis of the no-load Q value of the resonator.

* * * * *